US009802411B2

(12) United States Patent
Mizuno et al.

(10) Patent No.: US 9,802,411 B2
(45) Date of Patent: Oct. 31, 2017

(54) PRINT DEVICE AND NON-TRANSITORY COMPUTER READABLE MEDIUM

(71) Applicant: BROTHER KOGYO KABUSHIKI KAISHA, Nagoya-shi, Aichi-ken (JP)

(72) Inventors: Naoki Mizuno, Takahama (JP); Takao Hyakudome, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/386,842

(22) Filed: Dec. 21, 2016

(65) Prior Publication Data

US 2017/0173962 A1 Jun. 22, 2017

(30) Foreign Application Priority Data

Dec. 22, 2015 (JP) ..... 2015-250599

(51) Int. Cl.
*B41J 2/165* (2006.01)

(52) U.S. Cl.
CPC ..... *B41J 2/16523* (2013.01); *B41J 2/16535* (2013.01); *B41J 2002/16514* (2013.01); *B41J 2002/16573* (2013.01)

(58) Field of Classification Search
CPC B41J 2/07; B41J 2/16526; B41J 2002/16514; B41J 2002/1657; B41J 2/16535; B41J 2002/16573; B41J 29/393; B41J 2/16523; B41J 2/16517
See application file for complete search history.

(56) References Cited

U.S. PATENT DOCUMENTS 9,399,347 B1 7/2016 Mizuno et al.
2005/0231537 A1* 10/2005 Momose ..... B41J 2/16523 347/9
2015/0217565 A1* 8/2015 Fukuda ..... B41J 2/16508 347/10

FOREIGN PATENT DOCUMENTS

JP H09-183233 A 7/1997

* cited by examiner

*Primary Examiner* — Thinh H Nguyen
(74) *Attorney, Agent, or Firm* — K&L Gates LLP

(57) ABSTRACT

A nozzle arrangement of a head portion of a printer includes nozzle arrays arranged in a first direction. Each of the nozzle arrays has nozzles arranged in a second direction crossing the first direction. Each of the nozzles is provided to eject liquid. The printer includes a set of liquid passages provided to supply the liquid to the nozzle arrangement. The set of liquid passages has liquid passages interconnected via a communication path. The nozzles in each of the nozzle arrays is connected to a corresponding one of the liquid passages. In selective flushing that is performed a plurality of times, among the nozzles configuring the nozzle arrays, liquid is ejected from the nozzles arranged in a first region adjacent to the communication path.

13 Claims, 16 Drawing Sheets

PRINT DEVICE AND NON-TRANSITORY COMPUTER READABLE MEDIUM

CROSS-REFERENCE TO RELATED APPLICATION

This application claims priority to Japanese Patent Application No. 2015-250599 filed on Dec. 22, 2015, the disclosure of which is herein incorporated by reference in its entirety.

BACKGROUND

The present disclosure relates to a print device and a non-transitory computer readable medium.

A print device is known that performs flushing in order to improve an ejection state of an ink. The flushing is an operation that causes the ink to be ejected from nozzles in a non-print area. A device is known which includes a print head provided with many nozzles that are divided into a plurality of sections, and which performs the flushing at timings that are different from each other for each section.

SUMMARY

As an ink passage inside the print head, there is a case in which, for example, a communication path is provided, via which ends of a plurality of ink passages are interconnected. In order to remove the ink deposited inside the print head, it is conceivable that the nozzles in the vicinity of a sedimentation section only are caused to perform ejection. However, for example, in a case of a significant degree of sedimentation, the ejection may not be stable and the deposited ink may not be efficiently removed.

Embodiments of the broad principles derived herein provide a print device and a non-transitory computer readable medium storing a computer program that are capable of reducing a possibility of a deterioration in print quality occurring.

The embodiments herein provide a print device including: a head portion including a nozzle arrangement, the nozzle arrangement having nozzle arrays arranged in a first direction, each of the nozzle arrays having nozzles arranged in a second direction crossing the first direction, each of the nozzles being provided to eject liquid, and the nozzles having first nozzles, and second nozzles different from the first nozzles; a set of liquid passages provided to supply the liquid to the nozzle arrangement, the set of liquid passages having liquid passages arranged in the first direction and interconnected via a communication path, the nozzles in each one of the nozzle arrays being connected to a corresponding one of the liquid passages, each of the liquid passages extending in the second direction and having a first end and a second end in the second direction, the first end being connected to a supply port provided to supply the liquid to the liquid passage, and the second end being an end opposite to the first end and connected to the communication path; a controller provided to control a flushing operation of the head portion, the flushing operation being an operation of ejecting the liquid from the nozzles as waste liquid, and the waste liquid not being used for printing; and the controller being configured to control the head portion to perform a selective flushing operation, the selective flushing operation being an operation of ejecting the liquid from the first nozzles corresponding to a part, being at least one of the liquid passages, of the set of liquid passages while stopping ejection of the liquid from the second nozzles corresponding to a remaining part of the set of liquid passages, and the controller performing the selective flushing operation for a first number of times when the controller determines that an elapsed time from a previous flushing operation is longer than a first time period.

The embodiments herein also provide a non-transitory computer readable medium storing computer readable instructions. The computer readable instructions are executed by a processor of a print device provided with: a head portion including a nozzle arrangement, the nozzle arrangement having nozzle arrays arranged in a first direction, each of the nozzle arrays having nozzles arranged in a second direction crossing the first direction, each of the nozzles being provided to eject liquid, and the nozzles having first nozzles, and second nozzles different from the first nozzles; a set of liquid passages provided to supply the liquid to the nozzle arrangement, the set of liquid passages having liquid passages arranged in the first direction and interconnected via a communication path, the nozzles in each one of the nozzle arrays being connected to a corresponding one of the liquid passages, each of the liquid passages extending in the second direction and having a first end and a second end in the second direction, the first end being connected to a supply port provided to supply the liquid to the liquid passage, and the second end being an end opposite to the first end and connected to the communication path; and the processor provided to control a flushing operation of the head portion, the flushing operation being an operation of ejecting the liquid from the nozzles as waste liquid, and the waste liquid not being used for printing. When executed by the processor, the computer readable instructions perform processes including: first determining whether an elapsed time from a previous flushing operation is longer than a first time period; performing selective flushing, the selective flushing causing the liquid to be ejected from the first nozzles and stopping ejection of the liquid from the second nozzles; second determining whether the selective flushing is performed for a first number of times; and repeatedly performing the selective flushing until it is determined in the second determining that the selective flushing is performed for the first number of times, when it is determined in the first determining that the elapsed time is longer than the first time period.

BRIEF DESCRIPTION OF THE DRAWINGS

Embodiments will be described below in detail with reference to the accompanying drawings in which.

DETAILED DESCRIPTION

A schematic configuration of a printer 1 will be explained with reference to FIG. 1 and FIG. 2. The upper side, the lower side, the lower left side, the upper right side, the lower right side and the upper left side of FIG. 1 respectively correspond to the upper side, the lower side, the front side, the rear side, the right side and the left side of the printer 1.

Figure 1:
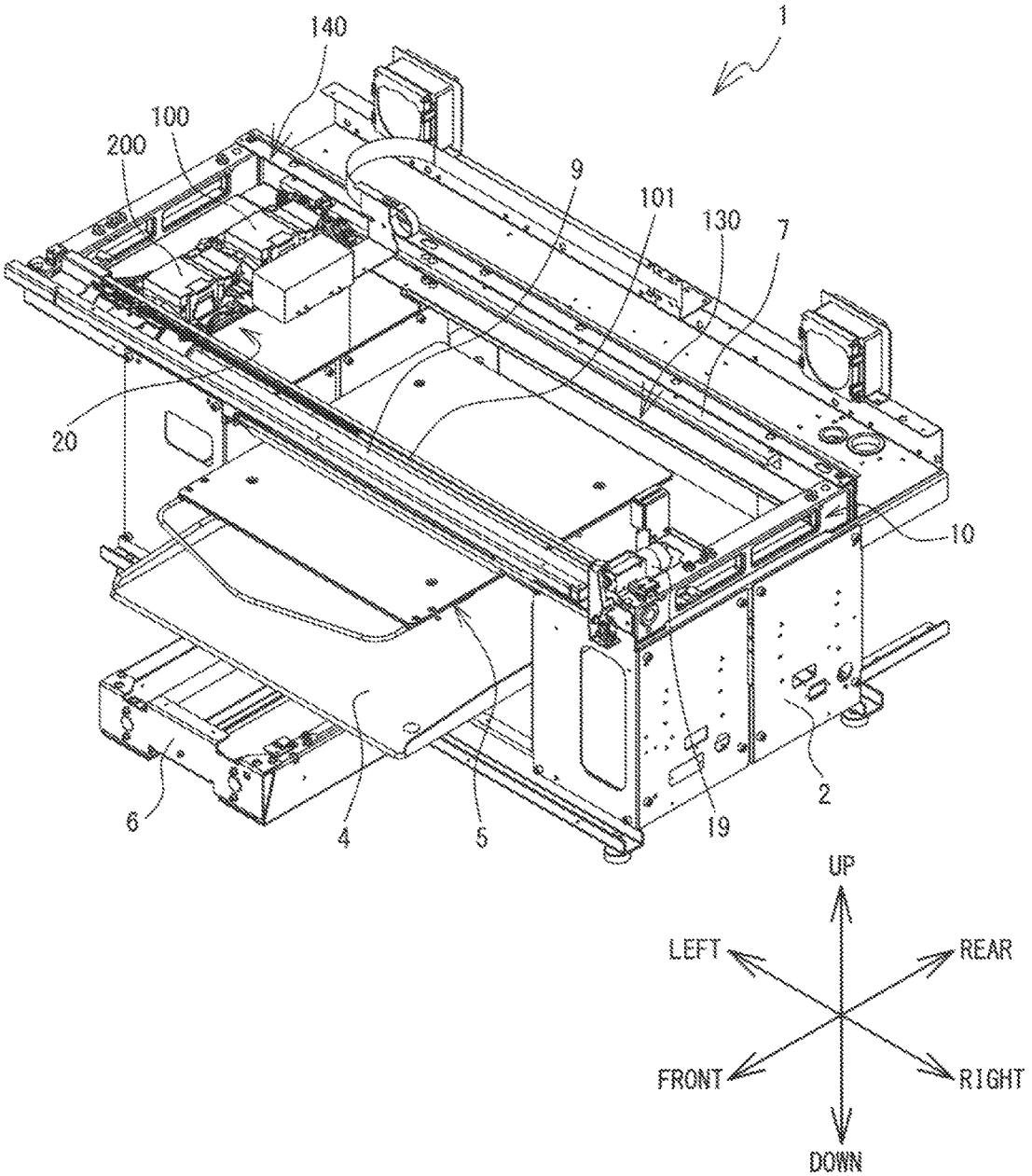
FIG. 1 is a perspective view of a printer.

As shown in FIG. 1, the printer 1 is an inkjet printer that performs printing by ejecting liquid ink onto a print medium (not shown in the drawings). The print medium of the printer 1 is a fabric, such as a T-shirt. The printer 1 may use paper or the like as the print medium. The printer 1 can print a color image on the print medium by downwardly ejecting five types of ink (white (W), black (K), yellow (Y), cyan (C) and magenta (M) inks) that are different in color from each other. In the explanation below, of the five types of ink, the white color ink is referred to as a white ink, and the inks of the four colors of black, cyan, yellow and magenta are collectively referred to as color inks. When the white ink and the color inks are collectively referred to or when one of the inks is not specified, the inks are simply referred to as ink.

The white ink that is used for the printer 1 contains titanium oxide as a pigment. The titanium oxide is an inorganic pigment having a relatively high specific gravity. When the titanium oxide pigment is used in an inkjet ink having a low viscosity, pigment particles are likely to be deposited. Therefore, for example, when the printing of the white ink is not performed for a long time, it is likely that the pigment particles may sediment and clogging may occur in ink passages inside the printer 1. In order to inhibit the clogging of the ink passages, it is necessary to maintain the fluidity of the white ink inside the ink passages by causing the white ink to be agitated. Although the color ink also contains pigment, the pigment contained in the color ink is less likely to sediment compared to the titanium oxide pigment contained in the white ink.

Figure 2:
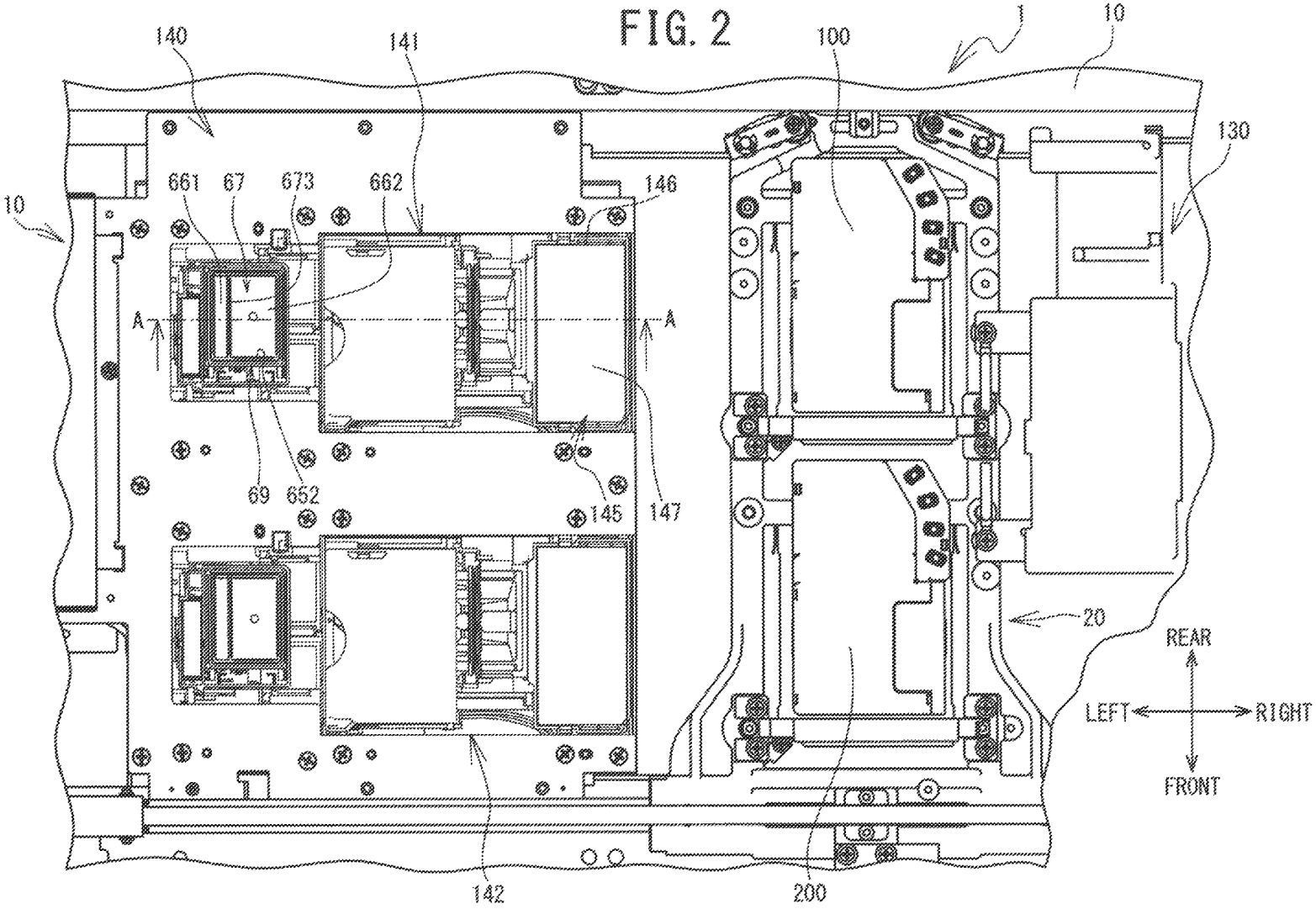
FIG. 2 is a plan view of the printer.

As shown in FIG. 1 and FIG. 2, the printer 1 is provided with a housing 2, a frame body 10, a guide shaft 9, a rail 7, a carriage 20, head units 100 and 200, a drive belt 101, a drive motor 19, a platen drive mechanism 6, a platen 5 and a tray 4.

Figure 11:
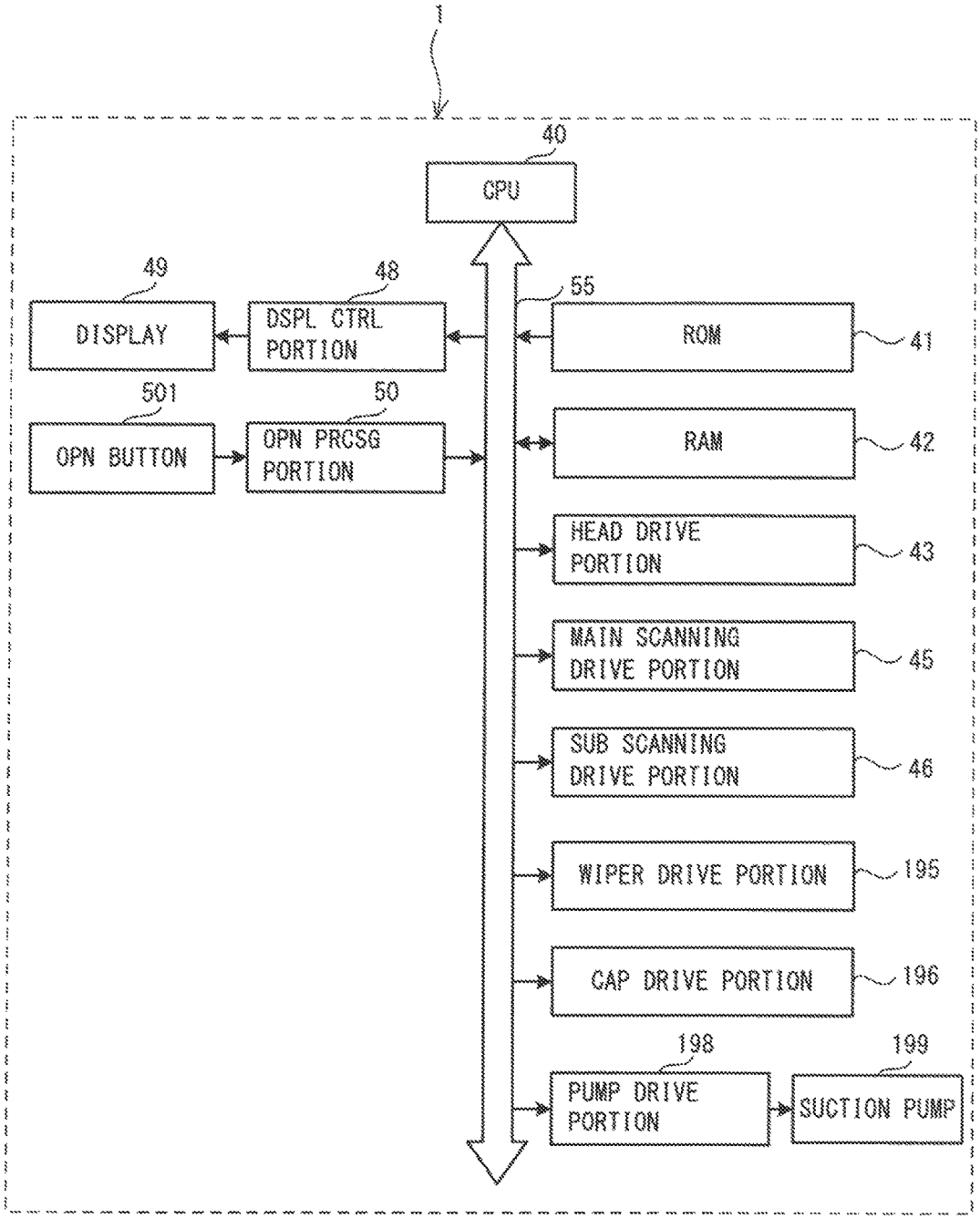
FIG. 11 is a block diagram showing an electrical configuration of the printer.

An operation portion (not shown in the drawings) used to perform operations of the printer 1 is provided in a front position on the right side of the housing 2. The operation portion is provided with a display 49 (refer to FIG. 11) and operation buttons 501 (refer to FIG. 11). The display 49 displays various types of information. The operation buttons 501 are operated when an operator inputs a command relating to various types of operations of the printer 1.

The frame body 10 has a frame shape and is substantially rectangular in a plan view. The frame body 10 is installed on an upper portion of the housing 2. The frame body 10 supports the guide shaft 9 on the front side and supports the rail 7 on the rear side, respectively. The guide shaft 9 is a shaft member and extends in the left-right direction inside the frame body 10. The rail 7 is a rod-like member that extends in the left-right direction, and is disposed facing the guide shaft 9.

The carriage 20 is supported such that it can be conveyed in the left-right direction along the guide shaft 9. As shown in FIG. 1 and FIG. 2, the head units 100 and 200 are installed on the carriage 20 such that they are arranged side by side in the front-rear direction. The head unit 100 is positioned to the rear of the head unit 200. A bottom portion of the head unit 100 is provided with a head portion 110 that can eject ink toward the print medium (refer to FIG. 3). A bottom portion of the head unit 200 is configured in the same manner as the head unit 100. The head portion 110 is provided with a nozzle surface 112 (refer to FIG. 3), which is a surface having a plurality of fine nozzles 111 (refer to FIG. 3) that can eject ink downwardly.

The drive belt 101 is stretched along the left-right direction on the inside of the frame body 10. The drive motor 19 is provided on the front right on the inside of the frame body 10. The drive motor 19 is coupled to the carriage 20 via the drive belt 101. When the drive motor 19 drives the drive belt 101, the carriage 20 reciprocates in the left-right direction (a scanning direction). As a result, the head units 100 and 200 reciprocate in the left-right direction.

The platen drive mechanism 6 is provided with a pair of guide rails (not shown in the drawings), the platen 5 and the tray 4. The pair of guide rails extend in the front-rear direction inside the platen drive mechanism 6, and support the platen 5 and the tray 4 such that they can move in the front-rear direction. The platen 5 is a substantially rectangular plate-shaped member in a plan view and is long in the front-rear direction. The platen 5 is provided below the frame body 10 that will be described later. An upper portion of the platen 5 holds the print medium. The tray 4 has a rectangular shape in a plan view and is provided below the platen 5. When a user places a T-shirt or the like on the platen 5, the tray 4 receives a sleeve or the like of the T-shirt. Therefore, the sleeve or the like is protected such that it does not come into contact with another component provided inside the housing 2. When the platen drive mechanism 6 is driven by a sub-scanning drive portion 46 (refer to FIG. 11) that will be described later, the platen drive mechanism 6 moves the platen 5 in the front-rear direction along the pair of guide rails. The ink is ejected from the head portion 110 that reciprocates in the left-right direction while the platen 5 is feeding the print medium in the front-rear direction (a sub-scanning direction), and thus the printing is performed on the print medium by the printer 1.

As shown in FIG. 1 and FIG. 2, within the movement path of the head units 100 and 200, an area in which the printing is performed by the head units 100 and 200 is referred to as a print area 130. An area other than the print area 130 within the movement path of the head units 100 and 200 is referred to as the non-print area 140. The non-print area 140 is a left end area of the printer 1. The print area 130 is an area from the right side of the non-print area 140 to a right end portion of the printer 1. The platen 5 and the tray 4 are provided in the print area 130.

As shown in FIG. 2, in the non-print area 140, the maintenance portions 141 and 142 are provided below the movement path of the head units 100 and 200, respectively. Various maintenance operations, such as flushing, purging and the like, are performed by the maintenance portions 141 and 142 in order to restore an ink ejection performance of the head units 100 and 200 and to secure the print quality of the printer 1. The flushing is an operation in which the head portion 110 ejects the ink above a flushing reception portion 145 (refer to FIG. 2), which will be described later, before the printing is performed on the print medium. Pigment particles deposited in a liquid passage 72, which will be described later, are removed by selective flushing that will be described later. Further, the ink pushed in from the outside by wipe processing, which will be described later, is removed by overall flushing that will be described later. Therefore, the ink is appropriately ejected from the head portion 110 when the printing is performed on the print medium. The purging (hereinafter also referred to as a "suction operation") is an operation that discharges the ink from the plurality of nozzles 111 by sucking the ink from the nozzles 111 using a suction pump 199 (refer to FIG. 11) in a state in which the nozzles 111 on the nozzle surface 112 are covered by a cap 67 (refer to FIG. 2 and FIG. 10) that will be described later. Since the ink whose viscosity has increased due to drying or the like in the vicinity of the nozzles 111 can be removed by performing the suction operation, it is possible to reduce a possibility of an ejection failure occurring in the head portion 110. These maintenance operations are performed by control of a CPU 40 (refer to FIG. 10) of the printer 1. The maintenance portions 141 and 142 will be described in more detail later.

Configurations of the head units 100 and 200 will be explained in detail with reference to FIG. 3 and FIG. 4. The head unit 100 ejects the white ink. The head unit 200 ejects the color inks. Before the color inks are ejected, the white ink is ejected onto the whole or a part of the area in which the printing is performed, as a base for printing when the color of the print medium is dark or the like. The white ink may be ejected to print a pattern or the like. The head unit 200 has a similar configuration to that of the head unit 100, except that the head unit 200 ejects the color inks instead of the white ink. Therefore, an explanation of the head unit 200 will be omitted as necessary. The head unit 100 may be a head unit that is dedicated to the white ink, or the white ink may be introduced into the head unit 200 that ejects the color inks.

Figure 3:
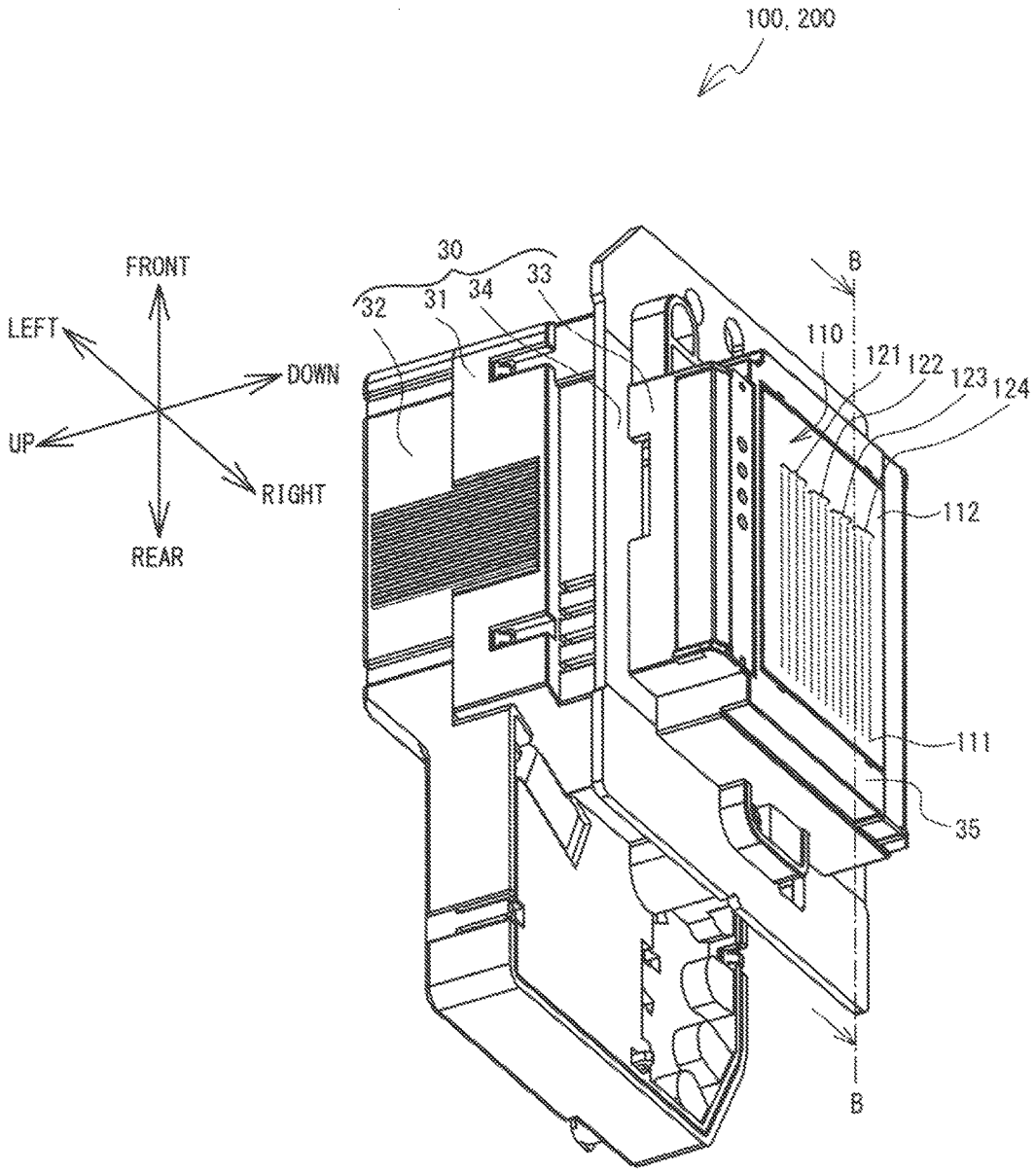
FIG. 3 is a perspective view of a head unit.
Figure 4:
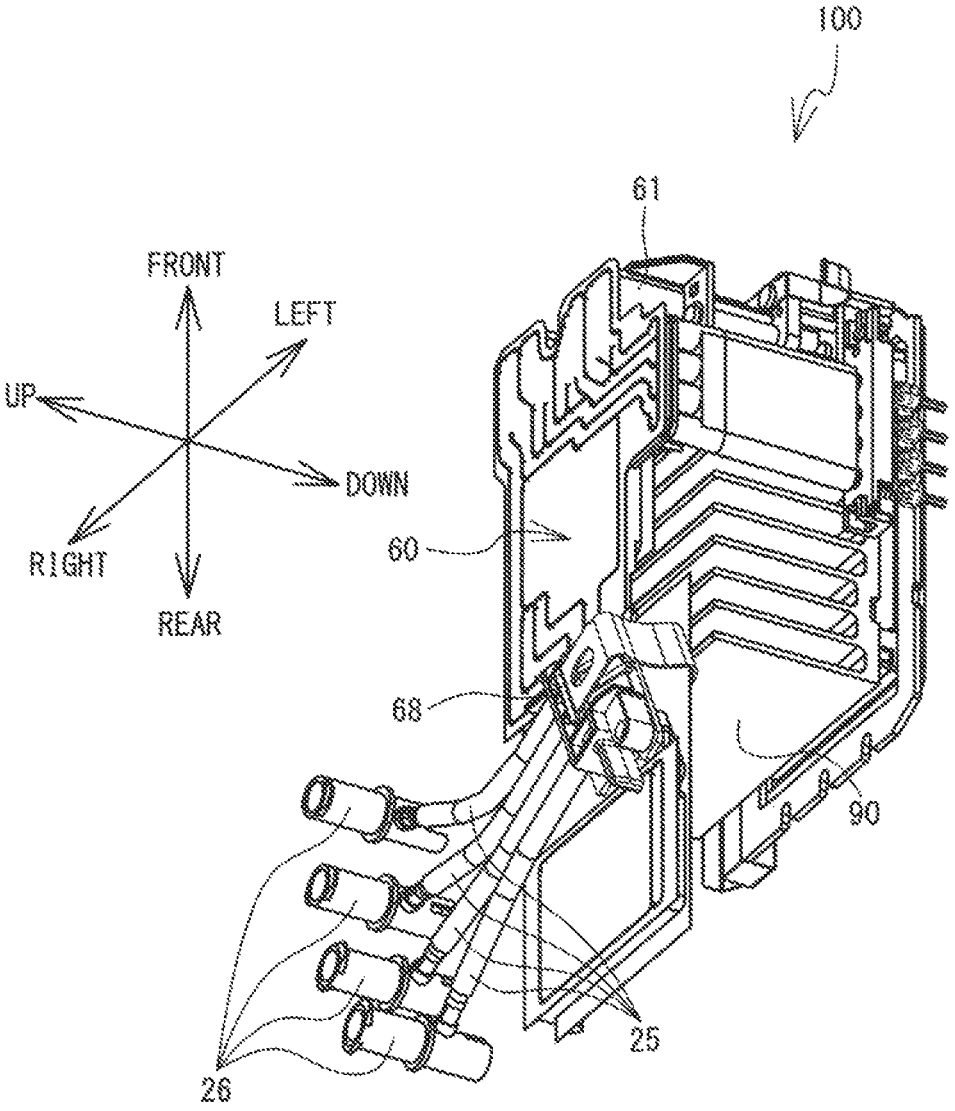
FIG. 4 is a perspective view of the interior of the head unit.

As shown in FIG. 3 and FIG. 4, the head unit 100 is provided with a housing 30, the head portion 110 and a buffer tank 60. As shown in FIG. 3, the housing 30 is a substantially box-shaped support body, and the head portion 110 is supported at a bottom portion of the housing 30. The housing 30 is provided with a support base 34, a middle housing 31, an upper housing 32 and a lower housing 33. The support base 34 is a metal plate member having a rectangular frame shape in a plan view. A through hole (not shown in the drawings) is formed in a central portion of the support base 34. The middle housing 31 is made of a synthetic resin and has a square tube shape extending upward from the support base 34. The middle housing 31 is fixed to an upper surface of the support base 34, in a position where a tube hole of the middle housing 31 is connected with the through hole of the support base 34. The upper housing 32 is made of a synthetic resin and has a substantially box shape whose lower side is open. The upper housing 32 is provided such that it covers the tube hole of the middle housing 31 and the buffer tank 60 (refer to FIG. 4) from the upper side, which is a side opposite to the head portion 110. The lower housing 33 is made of a synthetic resin and is provided with a bottom surface 35 having an opening. The lower housing 33 has a substantially box shape whose upper side is open. The lower housing 33 is fixed to a lower surface of the support base 34 in a state in which the head portion 110 is exposed downward from the opening of the bottom surface 35.

As shown in FIG. 3, the head portion 110 has a rectangular shape in a bottom view, and is provided such that it closes the opening of the bottom surface 35. The head portion 110 is formed by laminating stainless steel (SUS) plate shaped bodies in which fine holes are formed at positions corresponding to the plurality of nozzles 111. The head portion 110 is provided with the nozzle surface 112. The nozzle surface 112 is a surface having the plurality of nozzles 111 that can eject ink downward. The head portion 110 is supported from above by the lower housing 33 in a state in which the nozzle surface 112 is directed downward. The nozzle surface 112 is a surface that is parallel to the font-rear direction and the left-right direction, and forms the bottom surface of each of the head units 100 and 200. The interior of the head portion 110 is divided into four sections along the left-right direction. Therefore, the head unit 200 can selectively eject each of the color inks that are different in color from each other. The plurality of nozzles 111 correspond to a plurality of ejection channels (not shown in the drawings) that are provided inside the head portion 110. When a plurality of piezoelectric elements (not shown in the drawings) provided inside the head portion 110 are driven, the plurality of ejection channels make it possible for the ink to be ejected downward from the plurality of nozzles 111 that respectively correspond to the ejection channels.

As shown in FIG. 4, the buffer tank 60 is formed in a hollow cuboid shape. In an upper portion of the head unit 100, the buffer tank 60 extends in parallel with the nozzle surface 112. The ink can be supplied to the head portion 110 after a pressure fluctuation of the ink is absorbed, by the buffer tank 60 temporarily storing the ink supplied from a main tank via tubes 25 and connection units 26.

The four tubes 25, which supply the white ink, are connected to the buffer tank 60 of the head unit 100. The four tubes 25, which respectively supply the color inks of KYCM, are connected to the buffer tank 60 of the head unit 200. The connection unit 26 of each of the head units 100 and 200 connects the four tubes 25 with ink passages from the main tank (not shown in the drawings), which stores the ink on the right side of the housing 2. A vertical passage portion 61 is provided on a front end portion of the buffer tank 60. The vertical passage portion 61 extends in the up-down direction such that it couples the buffer tank 60 and the head portion 110. The interior of the vertical passage portion 61 is divided into four sections along the left-right direction. Therefore, in the head unit 200, the ink supplied from the four tubes 25 to the buffer tank 60 can be fed toward the head portion 110 for each of the KYCM colors.

Figure 6:
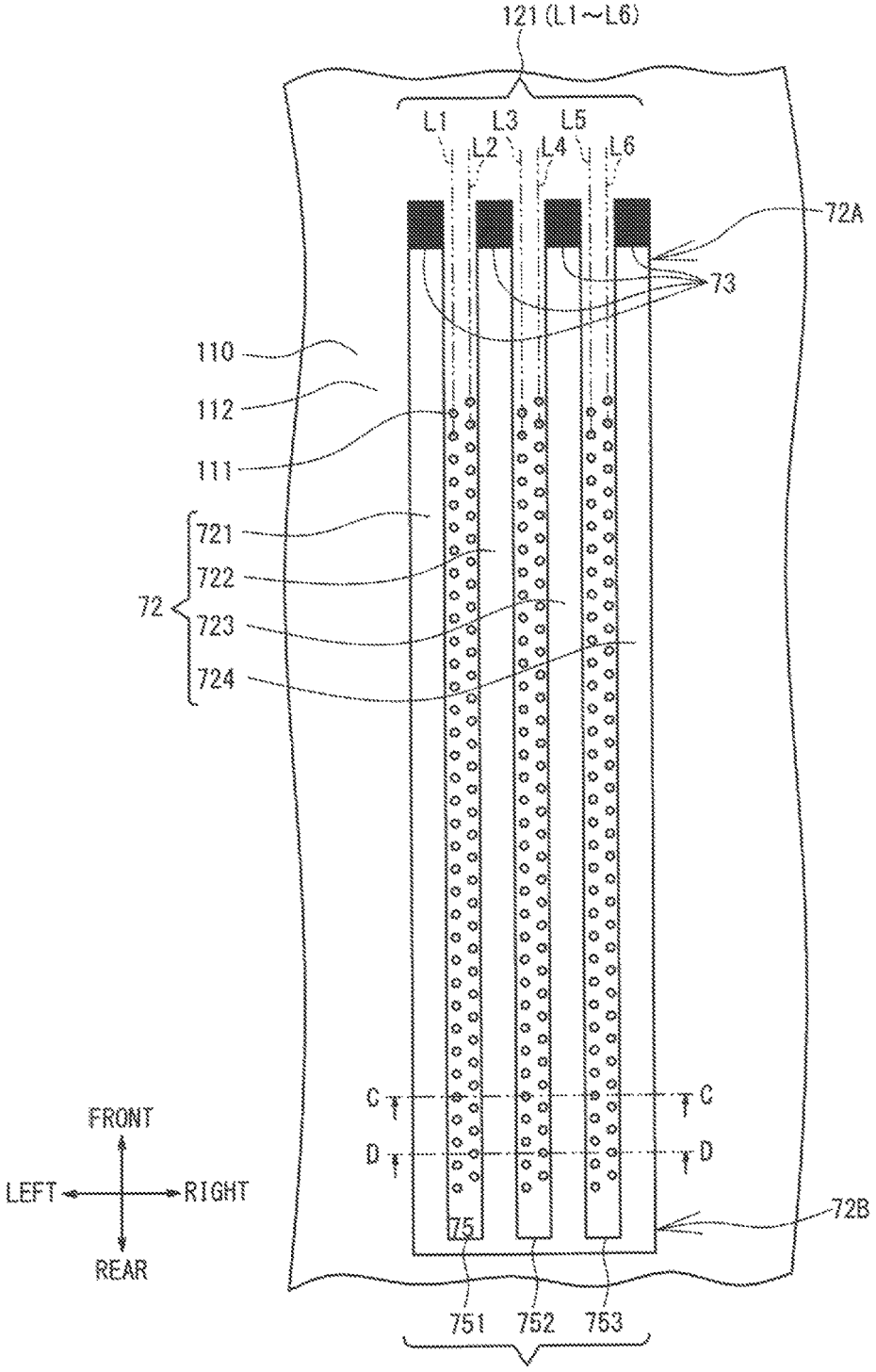
FIG. 6 is a schematic view showing the configuration of the ink passages when a head portion is seen from the side of a nozzle surface.
Figure 9:
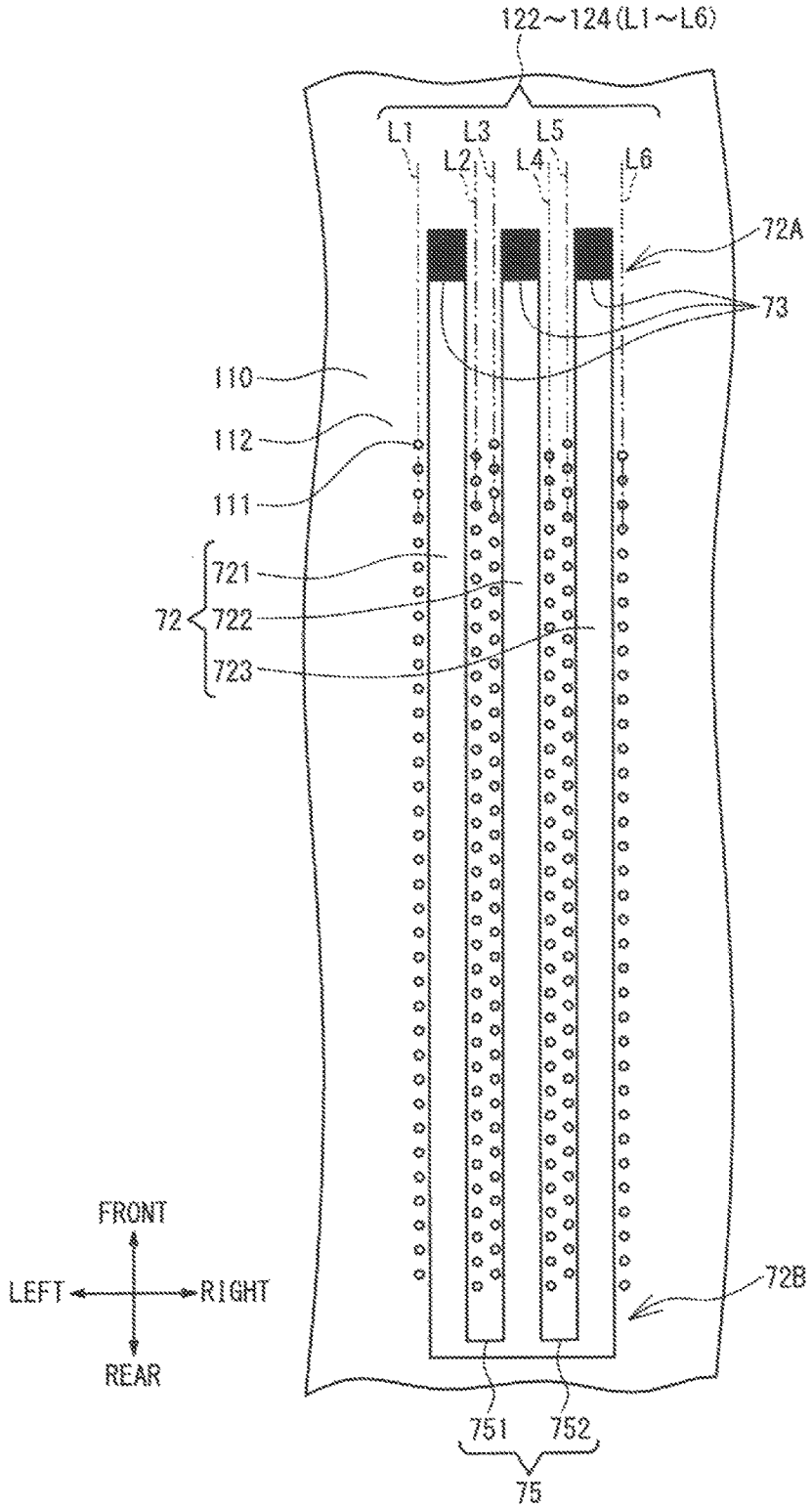
FIG. 9 is a schematic view showing a state in which selective flushing is performed in the head portion.

As shown in FIG. 3, the nozzle surface 112 has nozzle arrangements 121 to 124. Each of the nozzle arrangements 121 to 124 has a plurality of nozzle arrays. The nozzle arrays are arrays of the plurality of nozzles 111 that extend in the front-rear direction on the nozzle surface 112. The nozzle arrangement 121, the nozzle arrangement 122, the nozzle arrangement 123 and the nozzle arrangement 124 are arranged in that order from the left to the right. The ink is supplied to each of the nozzle arrangements 121 to 124 via the four tubes 25 and the buffer tank 60. More specifically, the nozzle arrangements 121 to 124 of the head unit 100 are nozzle arrangements that can respectively eject the white ink. The nozzle arrangements 121 to 124 of the head unit 200 can respectively eject the color inks that are different from each other. For example, the nozzle arrangement 121 ejects the black ink, the nozzle arrangement 122 ejects the yellow ink, the nozzle arrangement 123 ejects the cyan ink and the nozzle arrangement 124 ejects the magenta ink, respectively. Note that, as shown in FIG. 6 and FIG. 9, since the black ink has a higher viscosity than the yellow ink, the cyan ink and the magenta ink, the nozzle arrangement 121 may have a configuration different from the nozzle arrangements 122 to 124. Since the head unit 100 has a similar configuration to the head unit 200, the nozzle arrangement 121 in the head unit 100 also has a configuration different from the nozzle arrangements 122 to 124.

Configuration of Ink Passages

Figure 5:
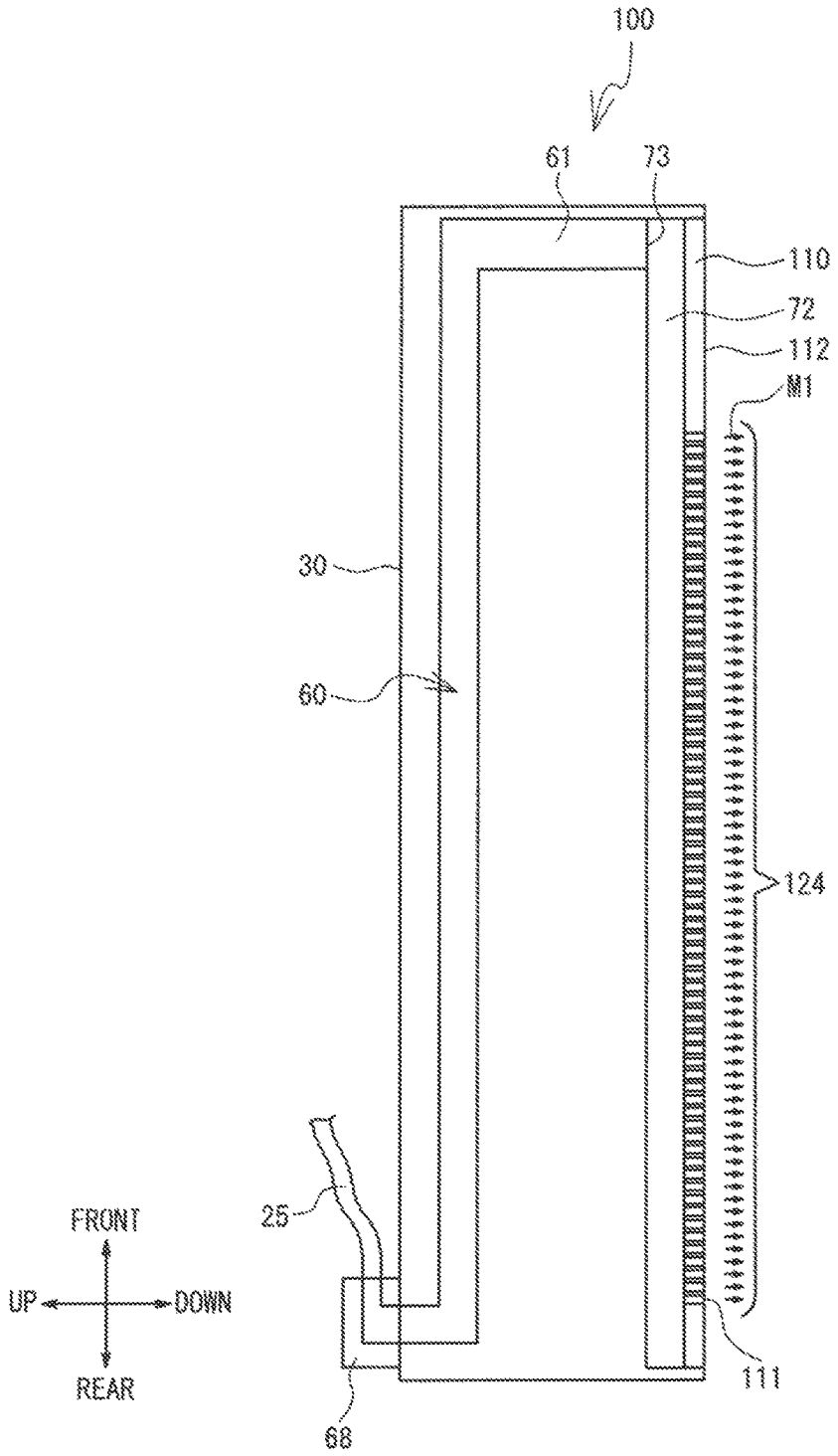
FIG. 5 is a schematic view showing a configuration of ink passages inside the head unit, and corresponding to a B-B cross section of the head unit shown in FIG. 3.

The configuration of the ink passages inside the head unit 100 will be explained with reference to FIG. 5 to FIG. 8. As shown in FIG. 5, the tubes 25 and the vertical passage portion 61 are connected to the buffer tank 60. The vertical passage portion 61 is connected to the front end portion of the buffer tank 60. A lower end portion of the vertical passage portion 61 is connected to the liquid passage 72 at a supply port 73 that is provided on a front end portion of the liquid passage 72. The liquid passage 72 is a passage to supply the ink supplied from the supply port 73 to the nozzle arrays, and extends in the front-rear direction in the head portion 110. FIG. 5 schematically shows a configuration example in which the ink that has been supplied via the tube 25 and the buffer tank 60 is supplied to the nozzle arrangement 121 via the liquid passage 72. Arrows M1 show a manner in which the ink supplied from the liquid passage 72 to the nozzle arrangement 121 is ejected from each of the plurality of nozzles 111. In FIG. 5, in order to facilitate understanding of the manner in which the ink is ejected from the nozzles 111, a bore diameter of the nozzles 111 is shown larger than an actual bore diameter of the nozzles 111. In order to simplify the drawing, FIG. 5 shows a smaller number of the nozzles 111 than the number of the nozzles 111 that are actually provided on the head portion 110. The nozzle arrangement 121 has a plurality of liquid passages 721 to 724 and a plurality of nozzle arrays L1 to L6 that are arranged in a first pattern shown in FIG. 6. The nozzle arrangements 122 to 124 have the plurality of liquid passages 721 to 723 and the plurality of nozzle arrays L1 to L6 that are arranged in a second pattern shown in FIG. 9. The nozzle arrangement 121 is different from the nozzle arrangements 122 to 124, in an arrangement pattern of the liquid passage 72 and the nozzle arrays L1 to L6. For example, although the configuration of the vicinity of the nozzle arrays in the nozzle arrangement 121, namely, the configuration of the liquid passage 72, the support port 73 and a communication path 75 that will be described later is similar to the case of the nozzle arrangements 122 to 124, the number of the liquid passages 72 in the nozzle arrangement 121 is different from the number of the liquid passages 72 in the nozzle arrangements 122 to 124. Hereinafter, the nozzle arrays L1 to L6, the liquid passage 72, the supply port 73 and the communication path 75 in the nozzle arrangement 121 and the nozzle arrangements 122 to 124 will be explained.

Configuration of the Nozzle Arrangement 121

As shown in FIG. 6, the nozzle arrangement 121 is provided with the nozzle arrays L1 to L6. Each of the nozzle arrays L1 to L6 is an array of the plurality of nozzles 111 that are arranged side by side in the front-rear direction on the nozzle surface 112. The nozzle array L1, the nozzle array L2, the nozzle array L3, the nozzle array L4, the nozzle array L5 and the nozzle array L6 are arranged in that order from the left to the right. Hereinafter, the nozzle arrays L2 to L5 that are provided between the nozzle arrays L1 and L6 provided at both the ends in the left-right direction that intersects the extending direction of the liquid passage 72 are referred to as "inside nozzle arrays." Further, in the nozzle arrangement 121, the liquid passages 722 and 723 that are provided between the liquid passages 721 and 724 provided at both the ends in the left-right direction that intersects the extending direction of the liquid passage 72 are referred to as "inside liquid passages." In the nozzle arrangements 122 to 124 shown in FIG. 9, the liquid passage 72 that is provided between the liquid passages 721 and 723 provided at both the ends in the left-right direction that intersects the extending direction of the liquid passage 72 is referred to as an "inside liquid passage." The nozzle array L1 and the nozzle array L2 are arranged adjacent to each other on the nozzle surface 112 such that the plurality of nozzles 111 included in the nozzle array L1 and the plurality of nozzles 111 included in the nozzle array L2 are arranged in a zigzag manner. The nozzle array L3 and the nozzle array L4, and the nozzle array L5 and the nozzle array L6 are also respectively arranged adjacent to each other, in the same manner as the nozzle array L1 and the nozzle array L2.

Figure 7:
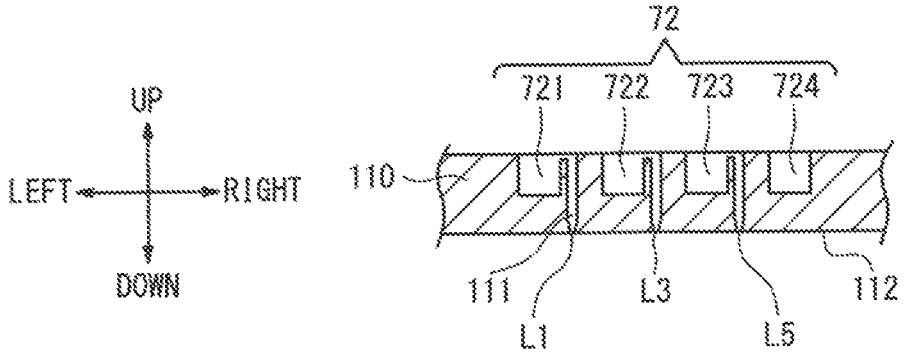
FIG. 7 is a cross-sectional view along C-C shown in FIG. 6.
Figure 8:
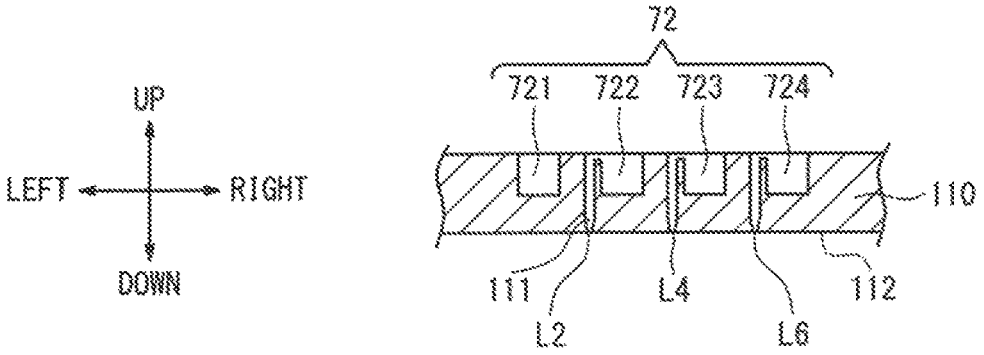
FIG. 8 is a cross-sectional view along D-D shown in FIG. 6.

In the head portion 110, the liquid passage 72 includes the liquid passages 721 to 724 that extend along the nozzle arrays L1 to L6, respectively. The liquid passages 721 to 724 are arranged from the left to the right in an order of the liquid passage 721, the liquid passage 722, the liquid passage 723 and the liquid passage 724. The liquid passage 721 is arranged to the left of the nozzle array L1. The liquid passage 722 is arranged between the nozzle array L2 and the nozzle array L3. The liquid passage 723 is arranged between the nozzle array L4 and the nozzle array L5. The liquid passage 724 is arranged to the right of the nozzle allay L6. As shown in FIG. 7 and FIG. 8, the liquid passage 721 is connected with the nozzles 111 included in the nozzle array L1. The liquid passage 722 is connected with the nozzles 111 included in the nozzle arrays L2 and L3. The liquid passage 723 is connected with the nozzles 111 included in the nozzle arrays L4 and L5. The liquid passage 724 is connected with the nozzles 111 included in the nozzle array L6. More specifically, the liquid passage 721 is a passage to supply the ink to the nozzle array L1. The liquid passage 722 is a passage to supply the ink to the nozzle arrays L2 and L3. The liquid passage 723 is a passage to supply the ink to the nozzle arrays L4 and L5. The liquid passage 724 is a passage to supply the ink to the nozzle array L6. In the explanation below, when the liquid passages 721 to 724 are collectively referred to or when they are not particularly distinguished from each other, they are referred to as the liquid passage 72 or the liquid passages 72.

As shown in FIG. 6, each of the liquid passages 72 includes a front end portion 72A provided with the supply port 73, and a rear end portion 72B. The communication path 75 is provided such that the rear end portions 72B of the plurality of liquid passages 72 are interconnected. The communication path 75 is provided with communication paths 751 to 753. The communication paths 751 to 753 are arranged from the left to the right in an order of the communication path 751, the communication path 752 and the communication path 753. The communication path 751 interconnects the rear end portion 72B of the liquid passage 721 and the rear end portion 72B of the liquid passage 722. The communication path 752 interconnects the rear end portion 72B of the liquid passage 722 and the rear end portion 72B of the liquid passage 723. The communication path 753 interconnects the rear end portion 72B of the liquid passage 723 and the rear end portion 72B of the liquid passage 724. In the explanation below, when the communication paths 751 to 753 are collectively referred to or when they are not particularly distinguished from each other, they are referred to as the communication path 75 or the communication paths 75.

The supply port 73 is provided at the front end portion 72A of each of the liquid passages 72. Therefore, it is likely that a necessary amount of ink for printing is sufficiently supplied to the nozzles 111 to which the ink is supplied from a section in the vicinity of the front end portion 72A of each of the liquid passages 72. It is more difficult for the ink supplied from the supply port 73 to reach the nozzles 111 to which the ink is supplied from a section in the vicinity of the rear end portion 72B of each of the liquid passages 72, because these nozzles 111 are farther from the supply port 73 in comparison to the nozzles 111 to which the ink is supplied from the section in the vicinity of the front end portion 72A of each of the liquid passages 72. Therefore, in the nozzles 111 to which the ink is supplied from the section in the vicinity of the rear end portion 72B of each of the liquid passages 72, there is a case in which the supply of ink from each of the liquid passages 72 is insufficient depending on an amount of ink required for printing. The communication paths 75 are provided to reduce the possibility of an insufficient supply of the ink occurring at the rear end portions 72B of the liquid passages 72. For example, when the ink is ejected from the nozzles 111 of the nozzle arrays L2 and L3 and the ink is not ejected from the other nozzle arrays L1, L4, L5 and L6, the ink in the liquid passages 721 and 723 can flow into the rear end portion 72B of the liquid passage 722 via the communication paths 751 and 752. The communication paths 75 that interconnect the rear end portions 72B of the plurality of liquid passages 72 are provided so that the ink can be supplied to the rear end portion 72B of one of the liquid passages 72 from another of the liquid passages 72. By doing this, the printer 1 reduces the possibility of an insufficient supply of the ink occurring at the rear end portions 72B of the liquid passages 72.

In the head portion 110, the liquid passages 72, the supply ports 73 and the communication paths 75 are disposed above the nozzle surface 112 (refer to FIG. 5, FIG. 7 and FIG. 8). Therefore, when the head unit 100 is seen from the nozzle surface 112 side, the liquid passages 72, the supply ports 73 and the communication paths 75 cannot actually be seen. In FIG. 6, the nozzle arrays L1 to L6, the liquid passages 72, the supply ports 73 and the communication paths 75 are all shown in solid lines in order to explain positional relationships between the nozzle arrays L1 to L6, the liquid passages 72, the supply ports 73 and the communication paths 75.

Configuration of the Nozzle Arrangements 122 to 124

As shown in FIG. 9, the nozzle arrangements 122 to 124 are provided with the nozzle arrays L1 to L6 similar to those of the nozzle arrangement 121. However, the arrangement of the nozzle arrays L1 to L6 is different from that of the nozzle arrangement 121. Further, in the nozzle arrangements 122 to 124, the number of the liquid passages 72 is three, which is one less than in the nozzle arrangement 121. In the same manner as in the nozzle arrangement 121, each of the nozzle arrays L1 to L6 is an array of the plurality of nozzles 111 that are arranged side by side in the front-rear direction on the nozzle surface 112. The nozzle array L1, the nozzle array L2, the nozzle array L3, the nozzle array L4, the nozzle array L5 and the nozzle array L6 are arranged in that order from the left to the right. The liquid passage 721 is provided between the nozzle array L1 and the nozzle array L2. The liquid passage 722 is provided between the nozzle array L3 and the nozzle array L4. The liquid passage 723 is provided between the nozzle array L5 and the nozzle array L6. The nozzle array L2 and the nozzle array L3 are arranged adjacent to each other on the nozzle surface 112 such that the plurality of nozzles 111 included in the nozzle array L2 and the plurality of nozzles 111 included in the nozzle array L3 are arranged in a zigzag manner. The nozzle array L4 and the nozzle array L5 are arranged adjacent to each other, in the same manner as the nozzle array L2 and the nozzle array L3. The nozzle array L1 is arranged in a zigzag manner with respect to the nozzle array L2 such that the liquid passage 721 is sandwiched between them. The nozzle array L6 is arranged in a zigzag manner with respect to the nozzle array L5 such that the liquid passage 723 is sandwiched between them.

In the head portion 110, the liquid passage 72 includes the liquid passages 721 to 723 that extend along the nozzle arrays L1 to L6, respectively. The liquid passages 721 to 723 are arranged from the left to the right in an order of the liquid passage 721, the liquid passage 722 and the liquid passage 723. The liquid passage 721 is arranged between the nozzle array L1 and the nozzle array L2. The liquid passage 722 is arranged between the nozzle array L3 and the nozzle array L4. The liquid passage 723 is arranged between the nozzle array L5 and the nozzle array L6. The liquid passage 721 is interconnected with the nozzles 111 included in the nozzle arrays L1 and L2. The liquid passage 722 is interconnected with the nozzles 111 included in the nozzle arrays L3 and L4. The liquid passage 723 is interconnected with the nozzles 111 included in the nozzle arrays L5 and L6. More specifically, the liquid passage 721 is a passage to supply the ink to the nozzle arrays L1 and L2. The liquid passage 722 is a passage to supply the ink to the nozzle arrays L3 and L4. The liquid passage 723 is a passage to supply the ink to the nozzle arrays L5 and L6.

As shown in FIG. 9, the communication path 75 that causes the liquid passages 72 to be interconnected with each other is provided at the rear end portion 72B of the liquid passage 72. The communication path 75 is provided with the communication paths 751 and 752. The communication paths 751 and 752 are arranged from the left to the right in an order of the communication path 751 and the communication path 752. The communication path 751 interconnects the rear end portion 72B of the liquid passage 721 and the rear end portion 72B of the liquid passage 722. The communication path 752 interconnects the rear end portion 72B of the liquid passage 722 and the rear end portion 72B of the liquid passage 723. Functions of the communication paths 751 and 752 are the same as those in the nozzle arrangement 121.

Configuration and Maintenance Operations of the Maintenance Portions 141 and 142

The configuration and maintenance operations of the maintenance portions 141 and 142 will be explained with reference to FIG. 2 and FIG. 10. The maintenance operations for the head units 100 and 200 are performed by the maintenance portions 141 and 142. Since the configuration and operations of the maintenance portion 141 are the same as those of the maintenance portion 142, an explanation of the maintenance portion 142 will be omitted as necessary in the explanation below.

Figure 10:
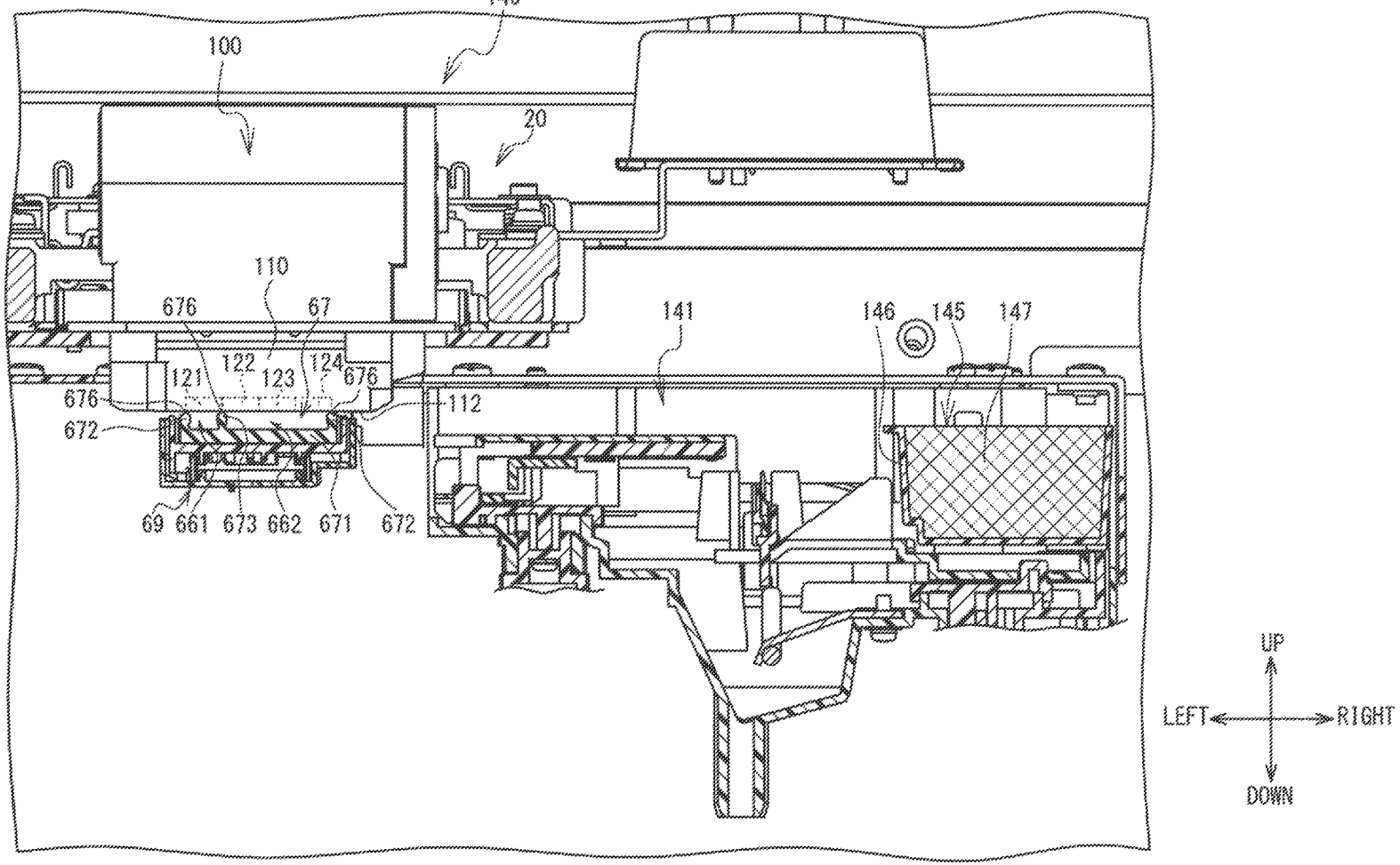
FIG. 10 is a cross-sectional view of the head unit along A-A shown in FIG. 2.

As shown in FIG. 2 and FIG. 10, the maintenance portion 141 is provided with the flushing reception portion 145, the cap 67 and a cap support portion 69. As shown in FIG. 2, the flushing reception portion 145 is a structure that is used for flushing, and is positioned in a right-side portion of the maintenance portion 141. The flushing reception portion 145 is provided with a container portion 146 and an absorber 147. The container portion 146 is a container that opens upward, and has a rectangular shape in a plan view. The absorber 147 is a cuboid-shaped member that can absorb the ink, and is disposed inside the container portion 146. The flushing reception portion 145 receives the ink ejected from the head unit 100 by the flushing. The ink received by the flushing reception portion 145 is absorbed by the absorber 147. The flushing is performed when the head unit 100 moves to a position above the flushing reception portion 145.

As shown in FIG. 10, the cap 67 and the cap support portion 69 are components that are used for suction processing, and are provided in a left-side portion of the maintenance portion 141. The cap 67 has a rectangular box shape in a plan view, and the upper side of the cap 67 is open. The cap 67 is disposed inside the cap support portion 69.

The cap 67 is made of a synthetic resin, such as silicon rubber, for example, and is provided with a bottom wall 671, a peripheral wall 672 and a partition wall 673. The bottom wall 671 is a plate-shaped wall portion that extends in the front-rear direction and the left-right direction, and forms a lower portion of the cap 67. In a plan view, the bottom wall 671 has a rectangular shape along an inner surface of the cap support portion 69. The peripheral wall 672 is a wall portion that is provided on the upper side of the cap 67, which is the nozzle surface 112 side, and extends upward from the peripheral edge of the bottom wall 671. The peripheral wall 672 is provided such that, in the up-down direction, it faces the periphery of a region in which the plurality of nozzles 111 are provided on the nozzle surface 112. When the printing is not being performed, the cap 67 covers the nozzle surface 112 and blocks the plurality of nozzles 111 from the outside air. Thus, the cap 67 suppresses an increase in ink viscosity due to evaporation or the like of ink components inside the nozzles 111, and also plays a role in reducing the possibility of a print failure occurring.

The partition wall 673 is a wall portion that is provided on the upper side of the cap 67, which is the nozzle surface 112 side, and extends upward from the bottom wall 671. The partition wall 673 is provided between the center, in the left-right direction, of the bottom wall 671 and a left end portion of the bottom wall 671, and extends in the front-rear direction. The front end and the rear end of the partition wall 673 are each connected with the peripheral wall 672. Cap lips 676, which are the upper end of the peripheral wall 672 and the upper end of the partition wall 673, have the same height (namely, the same vertical position) across their entire length, and are positioned higher than the upper end of the cap support portion 69.

The cap support portion 69 moves in the up-down direction when it is driven by a cap drive portion 196 (refer to FIG. 11) that will be described later. The cap 67 moves in the up-down direction integrally with the cap support portion 69. As shown in FIG. 10, the cap 67 that has moved upward comes into close contact with the nozzle surface 112 of the head unit 100 that has moved to the non-print area 140. At this time, the cap lips 676 of the cap 67 come into close contact with the periphery of the region in which the plurality of nozzles 111 are provided on the nozzle surface 112, and the cap 67 covers the plurality of nozzles 111 of the nozzle surface 112. In the explanation below, the position of the cap 67 and the cap support portion 69 when the cap 67 is in close contact with the nozzle surface 112 is referred to as a cover position. The position of the cap 67 and the cap support portion 69 when the cap 67 is not in close contact with the nozzle surface 112 is referred to as a cap separation position. The maintenance portion 141 is provided with the suction pump 199 (refer to FIG. 1 1) connected to the cap 67. The suction pump 199 is provided such that it can generate a negative pressure in inner areas 661 and 662, which are inside the cap 67 in the covering position. When the cap 67 and the cap support portion 69 are in the cover position, the purging is performed. When the cap 67 and the cap support portion 69 are in the cap separation position, the flushing is performed.

An electrical configuration of the printer 1 will be explained with reference to FIG. 10. The printer 1 is provided with the CPU 40 that controls the printer 1. The CPU 40 is electrically connected to a ROM 41, a RAM 42, a head drive portion 43, a main scanning drive portion 45, a sub-scanning drive portion 197, the cap drive portion 196, a pump drive portion 198, a display control portion 48 and an operation processing portion 50, via a bus 55.

The ROM 41 stores a control program to control operations of the printer 1 and initial values etc. The RAM 42 temporarily stores various types of data that are used in the control program. The head drive portion 43 is electrically connected to the head portion 110 that ejects the ink, and drives the piezoelectric elements provided in the respective ejection channels of the head portion 110 (refer to FIG. 3) so as to eject the ink from the nozzles 111.

The main scanning portion 45 includes the drive motor 19 (refer to FIG. 1) and moves the carriage 20 in the left-right direction (the scanning direction). The sub-scanning drive portion 46 includes a motor and a gear etc. that are not shown in the drawings, and drives the platen drive mechanism 6 (refer to FIG. 1), thereby moving the platen 5 (refer to FIG. 1) in the front-rear direction (the sub-scanning direction).

The cap drive portion 196 includes a cap drive motor (not shown in the drawings) and a gear etc., and moves the cap support potion 69 in the up-down direction, thereby moving the cap 67 in the up-down direction. Due to the drive of the cap drive portion 196, the cap support portion 69 of the maintenance portion 141 and the cap support portion 69 of the maintenance portion 142 move in the up-down direction at the same time. The pump drive portion 198 drives the suction pump 199. The display control portion 48 controls display of the display 49. The operation processing portion 50 outputs an operation input on the operation buttons 501 to the CPU 40. A wiper drive portion 195 drives a wiper 36 (refer to FIG. 2 and FIG. 10), which comes into contact with the nozzle surface 112 and wipes off the ink, to move in the up-down direction. A position in which the wiper 36 moves upward and comes into contact with the nozzle surface 112 is referred to as a wiper contact position. Further, a position in which the wiper 36 moves downward and separates from the nozzle surface 112 is referred to as a wiper separation position.

Maintenance processing by the CPU 40 of the printer 1 will be explained with reference to FIG. 12 to FIG. 15. In the maintenance processing, processing to perform the flushing, the wiping processing and the suction processing is performed. When the printing is not being performed, such as, for example, when the power source of the printer 1 is turned on, the CPU 40 operates based on the control program stored in the ROM 41. Thus, the CPU 40 controls the printer 1 and performs the maintenance processing shown in FIG. 11.

Figure 12:
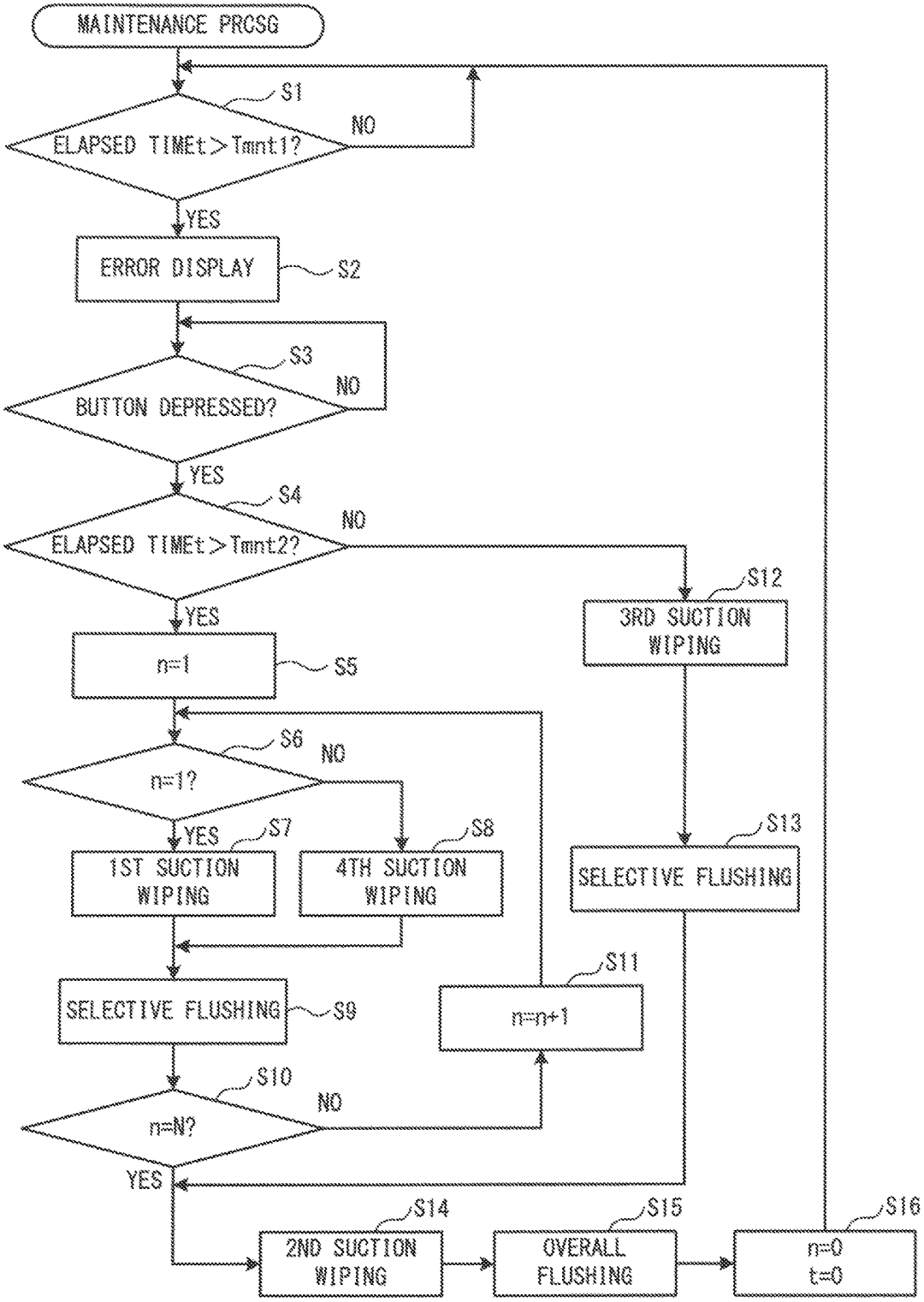
FIG. 12 is a flowchart of maintenance processing.

It is assumed that the cap 67 is in the cover position (refer to FIG. 10) before the maintenance processing is started. As shown in FIG. 12, when the maintenance processing is started, the CPU 40 determines whether or not an elapsed time t from a previous preliminary ejection (step S15) has exceeded Tmnt1 that is a predetermined time period set in advance (step S1). The preliminary ejection (step S15) is an operation in which overall flushing that ejects the ink from all of the nozzles 111 is performed. An example of Tmnt1 is approximately 24 hours. When the CPU 40 determines that the elapsed time t has exceeded Tmnt1 (yes at step S1), the CPU 40 performs an error display on a display 49 (step S2). When the CPU 40 determines that the elapsed time t has not exceeded Tmnt1 that is the predetermined time period set in advance (no at step S1), the CPU 40 returns the processing to step S1.

In the error display, the CPU 40 displays the message "Agitate the ink and press the operation button 501." (step S2). When the error display is performed, the processing proceeds to step S3. However, the processing may proceed to step S3 without performing the error display. The CPU 40 determines whether or not the operation button 501 has been depressed (step S3). When the CPU 40 determines that the operation button 501 has not been depressed (no at step S3), the CPU 40 returns the processing to step S3. When the CPU 40 determines that the operation button 501 has been depressed (yes at step S3), the CPU 40 determines whether or not the elapsed time t has exceeded Tmnt2 that is a predetermined time period set in advance (step S4). An example of Tmnt2 is approximately 48 hours. Tmnt2 is a longer time period than Tmnt1. When the CPU 40 determines that the elapsed time t has exceeded Tmnt2 (yes at step S4), the CPU 40 sets the value of a counter n stored in the RAM 42 to 1 (step S5). The counter n is stored in the RAM 42, and is a counter to count the number of times that selective flushing, which will be described later, is performed. Next, the CPU 40 determines whether or not the value of the counter n is 1 (step S6). When the CPU 40 determines that the counter n is equal to 1 (yes at step S6), the CPU 40 performs first suction processing and wipe processing (step S7).

In the first suction processing, the CPU 40 controls the cap drive portion 196, and moves the cap 67 to the cover position in which the cap 67 is in close contact with the nozzle surface 112 (step S7). Next, the CPU 40 controls the pump drive portion 198 and causes the suction pump 199 to generate a negative pressure in inner areas 661 and 662, which are inside the cap 67. The ink whose viscosity has increased due to drying or the like in the vicinity of the nozzles 111 is drawn out from the nozzles 111 and discharged (step S7). The control of a suction amount of the ink is performed by the CPU 40 controlling the pump drive portion 198 and adjusting a time period during which the suction pump 199 is driven or adjusting the number of revolutions of the suction pump 199. The amount of ink that is sucked in the first suction processing is a predetermined first suction amount. The first suction amount is larger than a second suction amount to a fourth suction amount that will be described later. As an example, the first suction amount is 6 cc.

The CPU 40 performs the wipe processing subsequent to the first suction processing (step S7). For example, the CPU 40 moves the cap support portion 69 downward by driving the cap drive portion 196 (refer to FIG. 11), and moves the cap 67 from the cover position to the cap separation position. Next, the CPU 40 moves the wiper 36 to the wiper contact position by controlling the wiper drive portion 195, and moves the carriage 20 in the left-right direction (the main scanning direction) by controlling the main scanning drive portion 45, thus causing the wiper 36 to wipe off the ink attached to the nozzle surface 112. The CPU 40 moves the wiper 36 to the wiper separation position by controlling the wiper drive portion 195.

Next, the CPU 40 performs the selective flushing for the head unit 100 (step S9). Note that, in the selective flushing and the overall flushing, a pulse drive signal of a drive frequency of 20 KHz, for example, is applied by the drive portion 43 to the piezoelectric elements, and thus the ink is ejected from the nozzles 111, at a rate of 20,000 times per second. In the processing at step S9, the CPU 40 drives the head drive portion 43 and transmits a drive signal for two seconds to the piezoelectric elements provided in the ejection channels that correspond to the nozzles 111 arranged in a first region E1 (which will be described later) of the head portion 110 of the head unit 100. By doing this, the printer 1 performs the selective flushing for the head unit 100.

Selective Flushing for the Nozzle Arrays L1 to L6 of the Nozzle Arrangement 121

Figure 13:
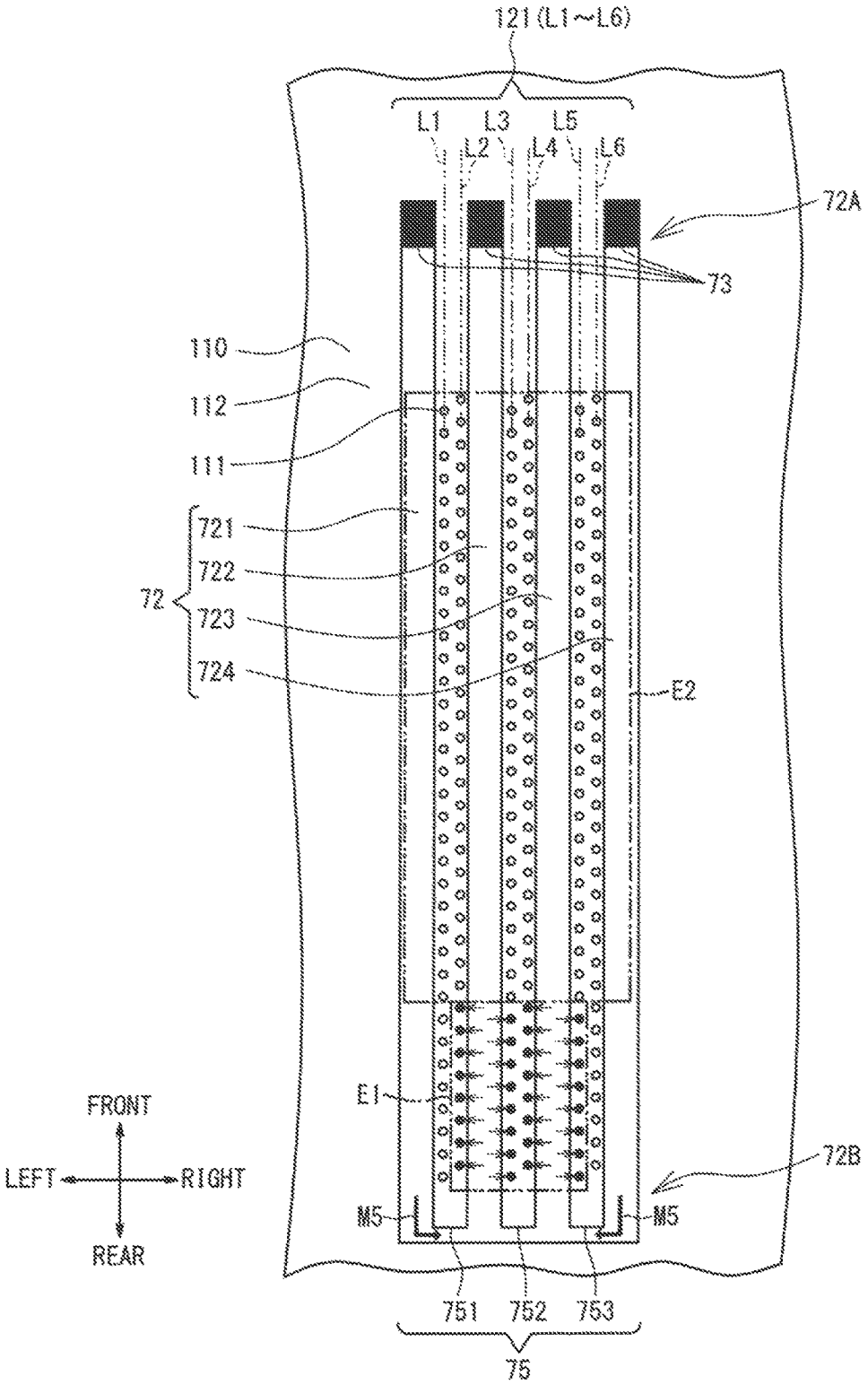
FIG. 13 is a schematic view showing a state in which selective flushing is performed in the head portion.

As shown in FIG. 13, the selective flushing is performed for the nozzles 111 included in the nozzle arrays L2 to L5 arranged in the first region E1, among the nozzle allays L1 to L6 of the nozzle arrangement 121. Note that, in FIG. 13 to FIG. 16, white circles show the nozzles 111 that do not eject ink in the selective flushing. Black circles show the nozzles 111 that eject ink in the selective flushing. In the selective flushing, among the nozzles 111 included in the nozzle arrays L2 to L5 of the nozzle arrangement 121, the ink is ejected from the nozzles 111 arranged in the first region E1, which is a region on the rear end portion 72B side of the liquid passages 72 that are adjacent to the communication paths 75. Among the nozzles 111 included in the nozzle arrays L2 to L5, the ink is not ejected from the nozzles 111 arranged in a second region E2, which is a region further to the front end portion 72A side (the side on which the supply ports 73 are disposed) of the liquid passages 72 than the first region E1.

When the ink is ejected from the nozzles 111 arranged in the first region E1 in the nozzle arrays L2 to L5, the ink in the rear end portion 72B side of the liquid passages 722 and 723 decreases and a negative pressure is generated in the rear end portion 72B side of the liquid passages 722 and 723. Due to the negative pressure, the ink is drawn out from the supply ports 73 of the liquid passages 722 and 723, and thus the ink is supplied to the liquid passages 722 and 723. Meanwhile the ink is not ejected from the nozzle arrays L1 and L6, and therefore, the ink is stored in the liquid passages 721 and 724. The ink stored in the liquid passages 721 and 724 is drawn out via the communication paths 75 due to the negative pressure generated in the rear end portion 72B side of the liquid passages 722 and 723, and flows toward the liquid passages 722 and 723 (refer to arrows M5 in FIG. 13). Therefore, it is easy for the ink to flow via the communication paths 75.

Selective Flushing for the Nozzle Arrays L1 to L6 of the Nozzle Arrangements 122 to 124

Figure 14:
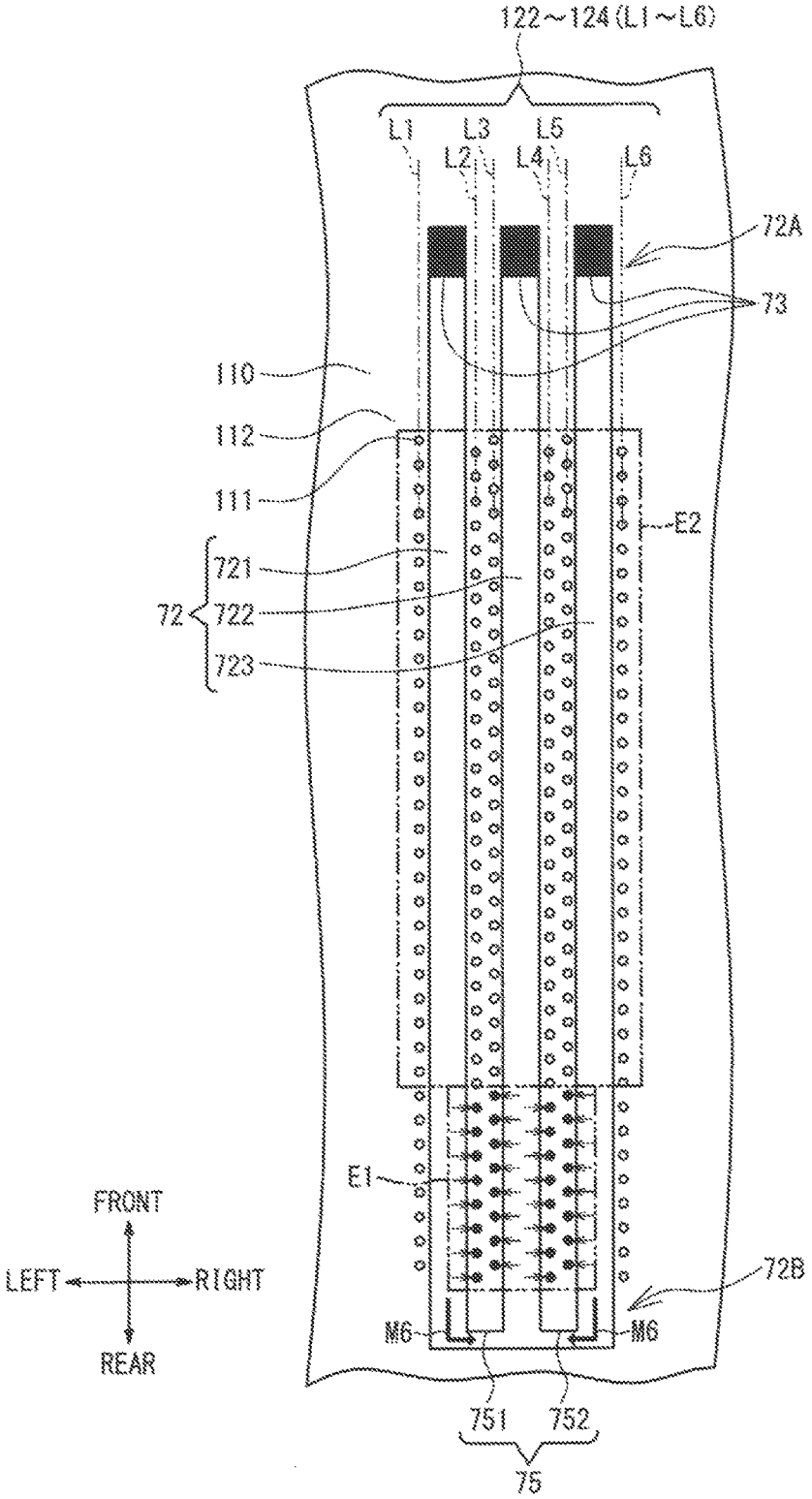
FIG. 14 is a schematic view showing a state in which selective flushing is performed in the head portion.

As shown in FIG. 14, the selective flushing is performed for the nozzles 111 included in the nozzle arrays L2 to L5 arranged in the first region E1, among the nozzle allays L1 to L6 of each of the nozzle arrangements 122 to 124. In the selective flushing, among the nozzles 111 included in the nozzle arrays L2 to L5 of the nozzle arrangements 122 to 124, the ink is ejected from the nozzles 111 arranged in the first region E1, which is a region on the rear end portion 72B side of the liquid passages 72 that are adjacent to the communication paths 75. Meanwhile, among the nozzles 111 included in the nozzle arrays L2 to L5, the ink is not ejected from the nozzles 111 arranged in the second region E2, which is a region further to the front end portion 72A side (the side on which the supply ports 73 are disposed) of the liquid passages 72 than the first region E1.

When the ink is ejected from the nozzles 111 arranged in the first region E1 in the nozzle arrays L2 to L5, the ink in the rear end portion 72B side of the liquid passages 721, 722 and 723 decreases and a negative pressure is generated in the rear end portion 72B side of the liquid passages 721, 722 and 723. Due to the negative pressure, the ink is drawn out from the supply ports 73 of the liquid passages 721, 722 and 723, and thus the ink is supplied to the liquid passages 721, 722 and 723. Although the ink is ejected from the nozzle arrays L2 and L5, the ink is not ejected from the nozzle arrays L1 and L6. Therefore, it is conceivable that a larger amount of ink is stored in the liquid passages 721 and 723 than in the liquid passage 722. Therefore, part of the ink stored in the liquid passages 721 and 723 is drawn out via the communication paths 75 due to the negative pressure generated in the rear end portion 72B side of the liquid passage 722, and flows toward the liquid passage 722 (refer to arrows M6 in FIG. 14).

Next, the CPU 40 determines whether the value of the counter n is N (step S10). N is a natural number stored in the RAM 42 and is, for example, 3. When the CPU 40 determines that the value of the counter n is not N (no at step S10), the CPU 40 adds 1 to the value of the counter n (step S11). Next, the CPU 40 determines whether the value of the counter n is 1 (step S6). In this case, since n is not equal to 1 (no at step S6), the CPU 40 performs fourth suction processing and the wipe processing (step S8). The fourth suction processing is an operation similar to the first suction processing. However, the amount of ink sucked from the nozzles 111 by the fourth suction processing (hereinafter referred to as the "fourth suction amount") is smaller than the first suction amount. The fourth suction amount is smaller than the first suction amount and the third suction amount that will be described later. As an example, the fourth suction amount is 2 cc.

The wipe processing performed at step S8 is the same as the wipe processing performed at step S7. Next, the CPU 40 performs the selective flushing for the head unit 100 in the same manner as described above (step S9). On the other hand, when the CPU 40 determines that the value of the counter n is N (yes at step S10), the CPU 40 performs second suction processing and the wipe processing (step S14). The second suction processing is an operation similar to the first suction processing and the fourth suction processing. However, the amount of ink sucked from the nozzles 111 by the second suction processing (hereinafter referred to as the "second suction amount") is, for example, smaller than the first suction amount and the same as the fourth suction amount. As an example, the second suction amount is 2 cc.

Next, the CPU 40 causes the overall flushing to be performed for the head unit 100 (step S15). The overall flushing is flushing that causes the ink to be ejected from the nozzles 111 provided in the first region E1, the second region E2, and to the left and right of the first region E1 on the head unit 100. For example, the overall flushing is flushing that causes the ink to be ejected from all of the nozzles 111 provided on the head unit 100. The CPU 40 drives the head drive portion 43 and transmits a drive signal for two seconds, for example, to all the piezoelectric elements provided in each of the ejection channels of the head portion 110 of the head unit 100. In this manner, the CPU 40 performs the overall flushing for the head unit 100.

Figure 15:
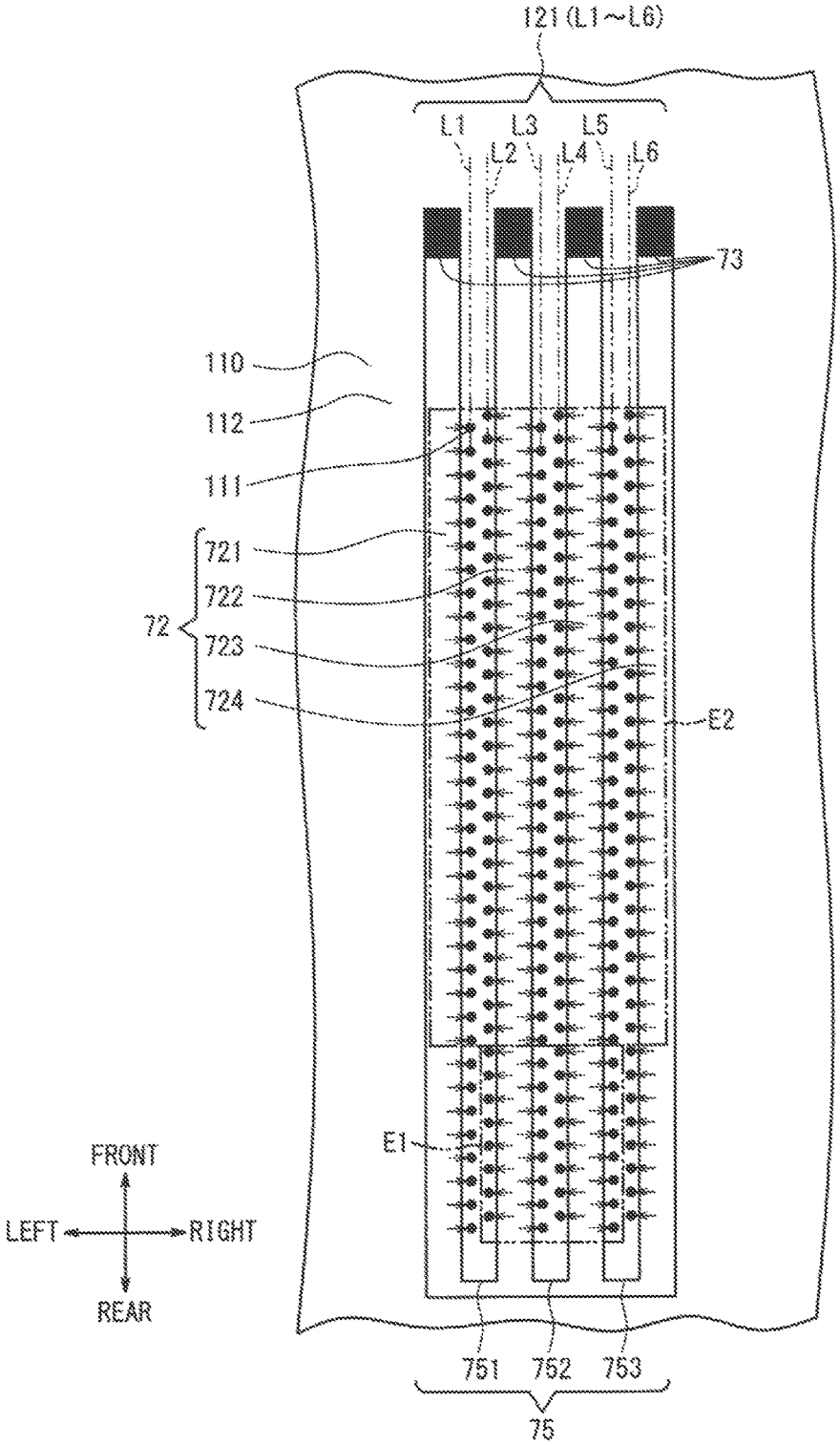
FIG. 15 is a schematic view showing a state in which overall flushing is performed in the head portion.
Figure 16:
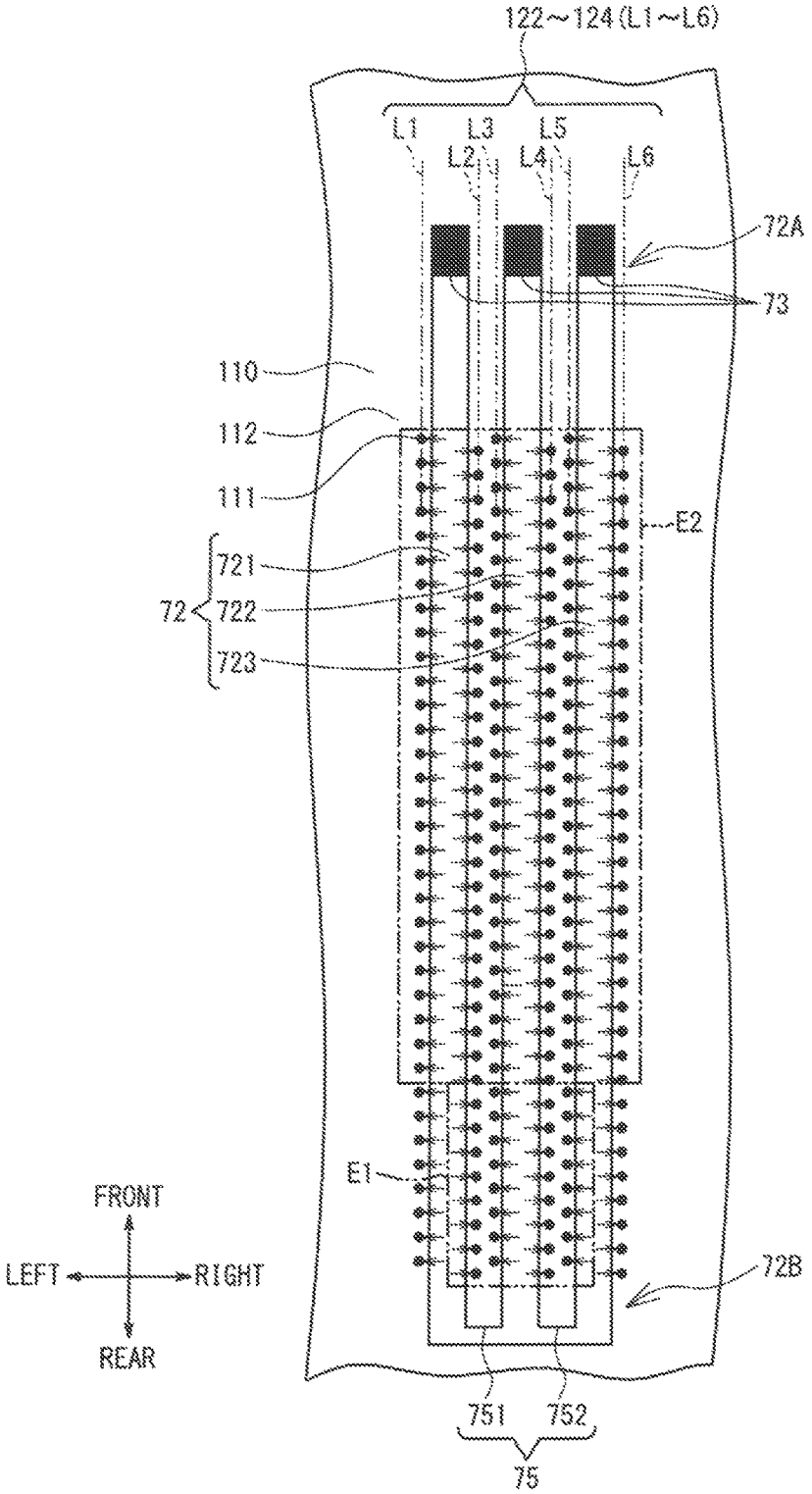
FIG. 16 is a schematic view showing a state in which overall flushing is performed in the head portion.

In the overall flushing, as shown in FIG. 15 and FIG. 16, the ink is ejected from all of the nozzles 111 included in the nozzle arrays L1 to L6. As a result, even when the ink with an increased viscosity is pushed into the nozzles 111 by the wipe processing (step S14) after the second suction processing, the ink with the increased viscosity is ejected. Next, the CPU 40 resets the value of the counter n and the value oft to 0 (step S16).

Note that, in the determination at step S4, when the CPU 40 determines that the elapsed time t has not exceeded Tmnt2 (no at step S4), the CPU 40 performs third suction processing and the wipe processing (step S12). The third suction processing is an operation similar to the first suction processing, the second suction processing and the fourth suction processing. However, the amount of ink sucked from the nozzles 111 by the third suction processing (hereinafter referred to as the "third suction amount") is smaller than the first suction amount, larger than the fourth suction amount, and larger than the second suction amount. As an example, the third suction amount is 4 cc. The wipe processing performed at step S12 is the same as the wipe processing performed at step S7. Next, the CPU 40 performs the selective flushing (step S13). The selective flushing performed at step S13 is the same as the selective flushing performed at step S9.

In the above-described embodiment, in the head unit 100, the nozzle arrangements 121 to 124 eject the white ink. Meanwhile, in the head unit 200, the corresponding nozzle arrangement 121 ejects the black ink and the corresponding nozzle arrangements 122 to 124 eject the yellow ink, the cyan ink and the magenta ink, respectively. Therefore, the number of ejections (an ejection number) of the ink is different between the selective flushing performed in the nozzle arrangement 121 and the selective flushing performed in the nozzle arrangements 122 to 124. In the selective flushing performed in the nozzle arrangement 121, the number of ejections (the ejection number) of the ink is larger than that of the selective flushing performed in the nozzle arrangements 122 to 124, and for example, almost twice the number of ejections of the ink is performed.

As explained above, the communication paths 75 are provided on the rear end portions 72B of the liquid passages 72, which are on the opposite side to the front end portions 72A where the supply ports 73 are provided. It is therefore likely that the liquid flow is slower in the communication paths 75 and in the vicinity of the communication paths 75 than in the vicinity of the supply ports 73. For example, in the communication paths 75 and in the vicinity of the communication paths 75, as time elapses from the overall flushing, the ink is likely to sediment and accumulate. This is because, when the white ink is used as the ink, titanium chloride particles tend to sediment and accumulate. In the head unit 100, when the elapsed time from the overall flushing (step S15) exceeds Tmnt2, which is a first time period, the CPU 40 performs the selective flushing for a first number of times (three times, for example). In the printer 1, the selective flushing is performed for the nozzle arrays L2 to L5 in the first region E1 that receive the liquid supply from the liquid passage 72 on the inside of the plurality of liquid passages 72. The selective flushing is performed for the nozzle arrays L2 to L5 which are arranged in the first region E1 adjacent to the communication paths 75 and whose liquid ejection state is particularly desired to be improved. It is thus possible to recover the state of the liquid ejection from the nozzles 111 in a favorable manner.

Further, the CPU 40 repeatedly performs the selective flushing until the CPU 40 determines that the selective flushing has been performed for the first number of times. Therefore, when the elapsed time from the previous flushing exceeds the first time period, the selective flushing is repeated for the first number of times. In order to remove the deposited ink, it is also conceivable to increase the ejection number of the ink in order to increase the amount of ink to be ejected from the nozzles 111 in a single flushing. However, when the ejection number of the ink is increased, the supply of the ink to the liquid passages 72 becomes insufficient, and the later stages of the flushing become unstable.

As a result, it may not possible to achieve an effective number of ejections in which the ink can be sufficiently ejected from the nozzles 111. For example, when a relatively large amount of ink is deposited, the flow in the communication path stagnates due to the deposited ink. As a result, the supply of the ink becomes insufficient and the later stages of the flushing become unstable. In contrast to this, in the printer 1, since the selective flushing is divided and performed for the first number of times, it is possible to effectively discharge the ink deposited inside the head portion 110. It is more favorable if the selective flushing is divided into several times and recovery processing, such as the suction processing from the nozzles or the wipe processing, is provided between the divided selective flushing, thus making it possible to effectively discharge the ink deposited inside the head portion 110. Further, it is likely that the liquid flows via the communication paths 75 from the liquid passages corresponding to the nozzle arrays L1 and L6 on which the selective flushing is not performed toward the liquid passages 722 and 723 corresponding to the nozzle arrays L2 to L5 on which the selective flushing has been performed. Thus, the printer 1 according to the present invention can suppress a deterioration in print quality by improving the liquid flow in the liquid passages 72.

In the printer 1, when the ink inside the nozzles 111 is left as it is, even when the piezoelectric elements are driven, there is a possibility that the ink may not be ejected due to the increased viscosity of the ink or the like. By performing the suction processing from the nozzles and the wipe processing before the selective flushing, the ink with the increased viscosity is removed and it is possible to restore the state in which the selective flushing can be performed.

When the elapsed time t exceeds Tmnt2, it is assumed that, for example, the ink in the nozzles 111 has dried out or the viscosity has increased due to the sedimentation of the pigment. Therefore, the first suction amount of the ink to be sucked in the first suction processing (step S7) that is initially performed is made larger than the suction amount of the ink to be sucked in the suction processing (step S8) from the second time onwards, and the ink with the increased viscosity is sufficiently removed. Thus, the ink whose viscosity has been increased is sucked by the initially performed first suction processing (step S8), and it is possible to remove the clogging of the nozzles 111. In the suction processing (step S8) from the second time onwards, since the high viscosity ink has already been removed, it is possible to suppress ink consumption by reducing the suction amount of the ink.

After the CPU 40 determines that the selective flushing (step S9) has been performed three times (yes at step S10), the CPU 40 performs the second suction processing (step S14) that sucks the ink of the second suction amount that is smaller than the first suction amount. Due to the second suction processing (step S14), it is possible to remove the ink whose viscosity has increased due to drying, from inside the nozzles 111 that have not ejected the ink in the selective flushing (step S9). It is therefore possible to reduce the clogging of the nozzles 111.

The CPU 40 controls the pump drive portion 198 such that the second suction amount of the ink to be sucked in the second suction processing (step S14) is smaller than the first suction amount (step S7) and the third suction amount (step S12), and is the same as the fourth suction amount (step S8). Note that, although in the above-described embodiment, the second suction amount is the same as the fourth suction amount, the second suction amount need not necessarily be limited to the same amount, and may be smaller than the fourth suction amount. When the second suction amount in the second suction processing (step S14) is made smaller than the first suction amount and the third suction amount, it is possible to reduce the liquid consumption.

When the CPU 40 determines that the elapsed time t has exceeded Tmnt1 and has not exceeded Tmnt2 (yes at step S1 and no at step S4), the CPU 40 performs the selective flushing for a second number of times (once, for example) that is smaller than the first number of times (three times, for example) (step S13). When the elapsed time t is between Tmnt1 and Tmnt2, the elapsed time t is shorter than Tmnt2. Therefore, there is a high possibility that the amount of the deposited ink is not significantly large. Therefore, even when the number of times of the flushing is reduced, there is a high possibility that the ink sediment deposited inside the head portion 110 can be removed. Further, it is possible to reduce the ink consumption by reducing the amount of consumed ink.

Before performing the selective flushing (step S13), the CPU 40 performs at least one of the third suction processing (step S12) that sucks the third suction amount of liquid, and the wipe processing (step S12). Thus, before performing the selective flushing (step S13), it is possible to recover the nozzles 111 from which the ejection is stopped.

The CPU 40 controls the pump drive portion 198 such that the third suction amount is smaller than the first suction amount and is larger than the second suction amount. When the elapsed time t is between Tmnt1 and Tmnt2, the elapsed time t is shorter than Tmnt2. Therefore, there is a high possibility that the viscosity of the ink is not high or the amount of the ink whose viscosity is high is not significantly large. Therefore, even when the suction amount in the third suction processing (step S12) is made to be smaller than the first suction amount and to be larger than the second suction amount, there is a high possibility that the ink sediment deposited inside the head portion 110 can be removed. Further, it is possible to suppress the ink consumption by reducing the amount of consumed ink.

The head portion 110 is provided with the nozzle arrangement 121 having the plurality of nozzles 111 that are arranged in the first pattern, and the nozzle arrangements 122 to 124 having the plurality of nozzles 111 that are arranged in the second pattern. The number (four) of the liquid passages 72 that supply the ink to the nozzle arrangement 121 is larger than the number (three) of the liquid passages 72 that supply the ink to the nozzle arrangements 122 to 124. The CPU 40 controls the head drive portion 43 such that the number of ejections (the ejection number) of the ink to be ejected by the selective flushing performed in the nozzle arrangement 121 is larger than the number of ejections (the ejection number) of the ink to be ejected by the selective flushing performed in the nozzle arrangements 122 to 124. Therefore, the number of ejections of droplets of the ink liquid to be ejected by the selective flushing can be set to a number that corresponds to the pattern of the nozzles 111. It is thus possible to eliminate an ejection failure in accordance with the pattern of the nozzles 111.

After the CPU 40 controls the head portion 110 and repeats the selective flushing (step S9) for the first number of times, the CPU 40 performs the second suction processing and the wipe processing (step S14). After that, the CPU 40 performs the overall flushing (step S15) that causes the ink to be ejected from the nozzles 111 in the first region E1, the nozzles 111 in the second region E2, and the nozzles 111 on both the left and right sides of the first region E1. Due to the second suction processing and the wipe processing (step S14), it is possible to optimize the meniscus of the nozzles 111. In addition, since the overall flushing is performed, even when the ink with the increased viscosity is pushed into the nozzles 111 by the wipe processing (step S14), the ink with the increased viscosity is ejected. It is therefore possible to suppress a deterioration in print quality.

The CPU 40 controls the head portion 110, and in the selective flushing (step S9, step S13), the CPU 40 causes the ink to be ejected from the nozzles 111 in the first region E1 that correspond to the inside liquid passages 722 and 723, and does not cause the ink to be ejected from the nozzles 111 in the first region E1 that correspond to the outside liquid passages 721 and 724. As a result, the flow (refer to the arrows M5 in FIG. 13) is generated from the outside liquid passages 721 and 724, via the communication paths 751 and 753, toward the nozzles 111 in the first region E1. Therefore, the ink with the increased viscosity stored in the liquid passages 72 can be discharged from the nozzles 111 in the first region E1, and it is thus possible to suppress a deterioration in print quality.

Note that the present invention is not limited to the above-described embodiment. For example, in the above-described embodiment, in the selective flushing (step S9, step S13), the flushing is performed for the nozzles 111 included in the nozzle arrays L2 to L5 in the first region E1, among the nozzle arrays L1 to L6 (refer to FIG. 13 and FIG. 14). The flushing may be performed for the nozzles 111 included in the nozzle arrays L2 to L5 in the first region E1, the nozzle array L1 adjacent to the left side of the first region E1, and the nozzle array L6 adjacent to the right side of the first region E1. The number of nozzle arrays is not limited to six. Any plural number of nozzle arrays may be provided.

In the selective flushing (step S9) that is repeatedly performed for the first number of times (three times, for example) by the CPU 40 controlling the head portion 110, the number of liquid droplets to be ejected may be increased in accordance with an increase in the number of repetitions. In this case, at first, there is a large amount of deposited ink, and therefore, there is a possibility that the ejection of the ink from the nozzles 111 in the selective flushing may become unstable. Therefore, at first, the selective flushing with a small ejection amount is performed, and the deposited ink is gradually ejected. In accordance with the increase in the number of repetitions of the selective flushing, the deposited ink decreases. Therefore, even when the number of liquid droplets to be ejected in the selective flushing is increased, the ejection does not become unstable. Thus, it is possible to increase the ejection amount in the later of the repetitions. It is thus possible to inhibit a deterioration in print quality.

Further, the "first number of times" need not necessarily be limited to three times, and may be any plural number of times, such as twice, four times, five times or the like. The "second number of times" may be any number of times as long as it is smaller than the "first number of times." Further, the maintenance processing shown in FIG. 12 may be performed for the head unit 200, without being limited to the head unit 100. When the color inks are used, it is also possible to inhibit the deterioration in the print quality by ejecting the ink with high viscosity. Regarding the first suction processing and the wipe processing (step S7), one of the first suction processing and the wipe processing may be performed. In the same manner, also in the processing at step S8, step S12 and step S14, one of them may be performed. In addition, the number of ejections (the ejection number) of the ink to be ejected by the selective flushing performed in the nozzle arrangement 121 may be the same as or smaller than the number of ejections (the ejection number) of the ink to be ejected by the selective flushing performed in the nozzle arrangements 122 to 124. The first suction amount, the second suction amount, the third suction amount and the fourth suction amount need not necessarily be limited to the above-described magnitude relationship and amounts, and all of them may be the same. Further, the first suction amount, the second suction amount, the third suction amount and the fourth suction amount may have a magnitude relationship different from that described above. Although in the above-described embodiment, the second suction amount is the same as the fourth suction amount, it may be smaller than the fourth suction amount. In other words, the second suction amount may be the smallest among the first suction amount, the second suction amount, the third suction amount and the fourth suction amount. All of the nozzle arrangements 121 to 124 may have the same configuration. The number of the liquid passages 72 need not necessarily be limited to three or four, and a given number of the liquid passages 72 may be provided corresponding to the number of the nozzle arrays.

All or part of the maintenance program that causes the above-described maintenance processing to be executed may be a program stored in the ROM 41. More specifically, the maintenance program can be stored in various types of storage devices that can be read by the CPU 40. Typically, the above-described storage device is a non-transitory storage medium, such as a hard disk drive (HDD). The non-transitory storage medium need not necessarily include a temporary storage medium, such as a transmission signal. Further, the maintenance program may be downloaded via a network, such as the Internet, and may be stored in the ROM 41.

A controller and a processor of the present invention are not limited to the CPU 40, and may be another electronic device, such as an application specific integrated circuit (ASIC) or a field-programmable gate array (FPGA), for example. More specifically, for example, the ASIC can be used instead of the CPU 40, the ROM 41 and the RAM 42. Functions of the controller and the processor of the present invention can be distributed to electronic devices, such as a plurality of CPUs. More specifically, each of the steps of the above-described flowchart may be performed through distributed processing by a plurality of electronic devices.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head portion including a nozzle arrangement, the nozzle arrangement having nozzle arrays arranged in a first direction, each of the nozzle arrays having nozzles arranged in a second direction crossing the first direction, each of the nozzles being provided to eject liquid, and the nozzles having first nozzles and second nozzles different from the first nozzles;

a set of liquid passages provided to supply the liquid to the nozzle arrangement, the set of liquid passages having liquid passages arranged in the first direction and interconnected via a communication path, the nozzles in each one of the nozzle arrays being connected to a corresponding one of the liquid passages, each of the liquid passages extending in the second direction and having a first end and a second end in the second direction, the first end being connected to a supply port provided to supply the liquid to the liquid passage, and the second end being an end opposite to the first end and connected to the communication path;

a controller provided to control a flushing operation of the head portion, the flushing operation being an operation of ejecting the liquid from the nozzles as waste liquid, and the waste liquid not being used for printing; and the controller being configured to control the head portion to perform a selective flushing operation, the selective flushing operation being an operation of ejecting the liquid from the first nozzles corresponding to a part, being at least one of the liquid passages, of the set of liquid passages while stopping ejection of the liquid from the second nozzles corresponding to a remaining part of the set of liquid passages, and the controller performing the selective flushing operation for a first number of times when the controller determines that an elapsed time from a previous flushing operation is longer than a first time period.

2. The print device according to claim 1, further comprising:

a cap configured to be selectively settable to a cover state in which the nozzles of the head portion are covered and a release state in which the nozzles are not covered;

a suction portion configured to generate a negative pressure inside the cap in the cover state;

a nozzle surface in the head portion, the nozzles being formed on the nozzle surface; and a wiper configured to wipe off the liquid attached to the nozzle surface;

wherein the controller is configured to control the suction portion to perform at least one of suction processing and wipe processing, the suction processing sucking the liquid from the nozzles, the wipe processing wiping off the liquid attached to the nozzle surface by the wiper, and the controller performing at least one of the suction processing and the wipe processing until the selective flushing is performed for the first number of times.

3. The print device according to claim 2, wherein when the controller determines that the elapsed time from the previous flushing operation is longer than the first time period, the controller controls the suction portion to suck the liquid of a first suction amount from the nozzles in first suction processing that is initially performed as the suction processing, the first suction amount being larger than a suction amount of the liquid to be sucked by the suction processing that is performed for a second time.

4. The print device according to claim 3, wherein after performing the selective flushing for the first number of times by controlling the suction portion, the controller performs second suction processing to suck the liquid of a second suction amount smaller than the first suction amount.

5. The print device according to claim 4, wherein the controller controls the suction portion such that the second suction amount is equal to or less than the suction amount of the liquid to be sucked by the suction processing performed for the second time.

6. The print device according to claim 5, wherein when the elapsed time is equal to or less than the first time period, the controller controls the suction portion to perform the selective flushing for a second number of times that is smaller than the first number of times.

7. The print device according to claim 6, wherein when the elapsed time is equal to or less than the first time period, before performing the selective flushing, the controller performs at least one of suction processing to suck a third suction amount of liquid and the wipe processing.

8. The print device according to claim 7, wherein the controller controls the suction portion such that the third suction amount is smaller than the first suction amount, larger than the suction amount of the liquid to be sucked by the suction processing performed for the second time, and larger than the second suction amount.

9. The print device according to claim 1, wherein the head portion has a first nozzle arrangement and a second nozzle arrangement, the first nozzle arrangement having the plurality of nozzle arrays arranged in a first pattern, and the second nozzle arrangement having a plurality of nozzle arrays arranged in a second pattern that is different from the first pattern in an arrangement between the plurality of liquid passages and the plurality of nozzle arrays, and the controller sets a number of ejections of droplets of the liquid to be ejected by the selective flushing for the first nozzle arrangement to be different from a number of ejections of droplets of the liquid to be ejected by the selective flushing for the second nozzle arrangement.

10. The print device according to claim 1, wherein the controller performs overall flushing after repeating the selective flushing for the first number of times, the overall flushing causing the liquid to be ejected from the first nozzles and the second nozzles.

11. The print device according to claim 1, wherein in the selective flushing, the controller causes the liquid to be ejected from the first nozzles corresponding to the liquid passage on the inside of the set of liquid passages, and stops ejection of the liquid from the first nozzles corresponding to the liquid passage on the outside of the set of liquid passages.

12. The print device according to claim 1, wherein in the selective flushing repeatedly performed for the first number of times, the controller increases the number of droplets to be ejected in accordance with an increase in the number of repetitions.

13. A non-transitory computer readable medium storing computer readable instructions which, when executed by a processor of a print device provided with:

a head portion including a nozzle arrangement, the nozzle arrangement having nozzle arrays arranged in a first direction, each of the nozzle arrays having nozzles arranged in a second direction crossing the first direction, each of the nozzles being provided to eject liquid, and the nozzles having first nozzles and second nozzles different from the first nozzles;

a set of liquid passages provided to supply the liquid to the nozzle arrangement, the set of liquid passages having liquid passages arranged in the first direction and interconnected via a communication path, the nozzles in each one of the nozzle arrays being connected to a corresponding one of the liquid passages, each of the liquid passages extending in the second direction and having a first end and a second end in the second direction, the first end being connected to a supply port provided to supply the liquid to the liquid passage, and the second end being an end opposite to the first end and connected to the communication path; and the processor provided to control a flushing operation of the head portion, the flushing operation being an operation of ejecting the liquid from the nozzles as waste liquid, and the waste liquid not being used for printing, perform processes comprising:

first determining whether an elapsed time from a previous flushing operation is longer than a first time period;

performing selective flushing, the selective flushing causing the liquid to be ejected from the first nozzles and stopping ejection of the liquid from the second nozzles;

second determining whether the selective flushing is performed for a first number of times; and repeatedly performing the selective flushing until it is determined in the second determining that the selective flushing is performed for the first number of times, when it is determined in the first determining that the elapsed time is longer than the first time period.

* * * * *